US006809275B1

(12) United States Patent
Cheng et al.

(10) Patent No.: US 6,809,275 B1
(45) Date of Patent: Oct. 26, 2004

(54) ROTARY AND PUSH TYPE INPUT DEVICE

(75) Inventors: Wendy H. W. Cheng, Santa Clara, CA (US); Don Rupert S. Desabilla, San Jose, CA (US); David W. Gillespie, Los Gatos, CA (US)

(73) Assignee: Synaptics, Inc., San Jose, CA (US)

( * ) Notice: Subject to any disclaimer, the term of this patent is extended or adjusted under 35 U.S.C. 154(b) by 48 days.

(21) Appl. No.: 10/145,353

(22) Filed: May 13, 2002

(51) Int. Cl.[7] ..... H01H 3/00
(52) U.S. Cl. ..... 200/14; 200/11 TW; 200/18
(58) Field of Search ..... 200/4, 9, 11, 14, 200/18

(56) References Cited

U.S. PATENT DOCUMENTS

| | | | | |
|---|---|---|---|---|
| 4,799,049 A | | 1/1989 | Avila | 340/709 |
| 4,823,634 A | | 4/1989 | Culver | 74/471 XY |
| 4,896,554 A | | 1/1990 | Culver | 74/471 XY |
| 5,446,481 A | | 8/1995 | Gillick et al. | 345/163 |
| 5,448,240 A | | 9/1995 | Morito | 341/176 |
| 5,473,344 A | | 12/1995 | Bacon et al. | 345/163 |
| 5,530,455 A | | 6/1996 | Gillick et al. | 345/163 |
| 5,543,592 A | * | 8/1996 | Gaultier et al. | 200/6 A |
| 5,593,023 A | | 1/1997 | Kaizaki et al. | 200/570 |
| 5,613,600 A | | 3/1997 | Yokoji et al. | 200/564 |
| 5,638,061 A | | 6/1997 | Levin et al. | 341/20 |
| 5,711,415 A | | 1/1998 | Fukuda et al. | 200/570 |
| 5,808,568 A | | 9/1998 | Wu | 341/20 |
| 5,886,310 A | | 3/1999 | Kataoka et al. | 200/14 |
| 5,912,661 A | | 6/1999 | Siddiqui | 345/166 |
| 5,963,197 A | | 10/1999 | Bacon et al. | 345/163 |
| 6,014,130 A | | 1/2000 | Yung-Chou | 345/163 |
| 6,157,369 A | | 12/2000 | Merminod et al. | 345/157 |
| 6,188,389 B1 | | 2/2001 | Yen | 345/156 |
| 6,188,393 B1 | | 2/2001 | Shu | 345/184 |
| 6,194,673 B1 | | 2/2001 | Sato et al. | 200/4 |
| 6,198,057 B1 | | 3/2001 | Sato et al. | 200/28 |
| 6,211,474 B1 | | 4/2001 | Takahashi | 200/18 |
| 6,218,635 B1 | | 4/2001 | Shigemoto et al. | 200/570 |
| 6,229,103 B1 | | 5/2001 | Yamamoto et al. | 200/4 |
| 6,246,392 B1 | | 6/2001 | Wu | 345/163 |
| 6,285,355 B1 | | 9/2001 | Chang | 345/163 |
| 6,291,782 B1 | * | 9/2001 | Isikawa | 200/4 |
| 6,292,113 B1 | | 9/2001 | Wu | 341/20 |
| 6,393,165 B1 | | 5/2002 | Yeh | 382/325 |

FOREIGN PATENT DOCUMENTS

| | | | |
|---|---|---|---|
| EP | 0 531 829 A1 | 3/1993 | H03J/9/06 |
| EP | 0 662 669 A2 | 7/1995 | G06K/11/18 |
| EP | 0 662 669 A3 | 1/1996 | G06K/11/18 |
| EP | 0 984 351 A2 | 3/2000 | G06F/3/033 |
| WO | WO 93/03475 A1 | 2/1993 | G09G/5/00 |
| WO | WO 98/43202 A1 | 10/1998 | G06K/11/18 |

* cited by examiner

*Primary Examiner*—Renee Luebke
(74) *Attorney, Agent, or Firm*—Ingrassia Fisher & Lorenz, P.C.

(57) ABSTRACT

The disclosure describes a button wheel. The button wheel comprises a support frame including a pair of parallel opposed inner surfaces. A platform is nestably mounted in the support frame. The platform includes a pair of parallel opposed outer surfaces forming a pair of linear bearings with the parallel opposed inner surfaces of the support frame to allow the platform to translate from a biased rest position in a direction parallel to the opposed inner surfaces and the opposed outer surfaces. The button wheel also includes first and second spaced apart mounts fixed to one of the support frame and said platform. The button wheel includes a shaft disposed along an axis and including a first end rotatably engaged in the first mount and a second end rotatably engaged in the second mount. A wheel is mounted on the shaft and a rotation sensor is in operative communication with the wheel. The button wheel also includes a translation sensor coupled between the support frame and the platform.

21 Claims, 17 Drawing Sheets

ROTARY AND PUSH TYPE INPUT DEVICE

BACKGROUND

This application relates to an electronic device capable of sensing rotary and push-type user inputs.

The button-wheel is a device that can sense continuous rotation about a rotational axis as well as switch action in a direction perpendicular to the rotational axis; it increases user efficiency by enabling users to transmit two distinct types of input to a host machine while interacting with only one device.

Button-wheels are also related to knob-buttons that include rotational knobs that support a switching function perpendicular to the axis of rotation. These knob-buttons typically actuate switches through movement of knobs and knob mountings.

Button-wheels are currently prevalent in cursor control devices such as computer mice. Most conventional mouse button-wheels possess a configuration and switch actuation method similar to the one described in U.S. Pat. No. 5,912,661 to Siddiqui and illustrated in FIG. 1. The button-wheel is built on a circuit board 28 that physically supports both mechanical and electrical components while placing button-wheel sensors in electrical communication with the rest of the mouse. The wheel 22 has a diameter that is much greater than its width. Wheel 22 is mounted on a relatively rigid shaft 64 that is much longer than wheel 22's width. Shaft 64 is held in place by two bearings that allow shaft 64 to rotate about its axis, but not translate along this axis.

A first bearing 32 further constrains a first end 991 of shaft 64 from moving in the other two translational directions; however, first bearing 32 does not prevent shaft 64 from tilting about first bearing 32. A second bearing is formed by two distinct components: a spring 58 that biases second end 992 and wheel 22 toward the user, and a slotted shape 34 that constrains second end 992, such that it can translate only within the slot cutout. The slot cutout is a straight slot that is perpendicular to the axis of shaft 64; this limits the motion of second end 992 to almost directly towards or away from circuit board 28. Shaft 64 also has a collar-type feature 50, located near slotted shape 34, that hovers above a button 51 of switch 52.

With this configuration, when the user pushes on wheel 22, shaft 64 tilts about first bearing 32 and sweeps a wedge-shaped section of a circle. Shaft 64 compresses spring 58, and collar 50 touches and depresses button 51 to actuate switch 52. The magnitude of shaft 64's tilt is limited by the length of the slot in slotted shape 34, the full compression distance of spring 58, and the actuation distance of button 51. Spring 58 and button 51 together generate the desired user tactile and auditory feedback for this switch actuation action. Conductive paths along the circuit board 28 route the button signals to the mouse electronics (not shown).

Also on shaft 64 is an encoder disc 44, which forms a complete optical rotary encoder with an optical emitter 46 and an optical detector 48. Shaft 64 further contains a series of grooves that interact with a ratchet-like feature 42 to form a detent mechanism. When the user rotates wheel 22, the encoder assembly (formed by encoder disc 44, optical emitter 46, and optical detector 48) produces digital signals that are typically quadrature in nature. The detent mechanism (formed by grooves 40 and ratchet 42) generates the desired user tactile and auditory feedback for the rotational motion. Conductive paths along the circuit board 28 route the encoder signals to the mouse electronics (not shown).

Variations on this general button-wheel idea are known in the art. The simplest variations involve using different types of the basic components (such as mechanical encoders instead of optical encoders, ball detents instead of grooves and ratchets, and lever-type switches instead of pushbutton switches) and shifting their relative location (such as moving switch 52 to the other side of slotted shape 34 or placing encoder disc 44 to the opposite side of first bearing 32).

Slightly more complex variations involve combining many components into one integral unit. U.S. Pat. No. 6,188,393 to Shu, U.S. Pat. No. 6,157,369 to Merminod et al., and U.S. Pat. No. 6,014,130 to Yung-Chou describe devices in which the encoder disc (analogous to encoder disc 44 of the Siddiqui patent '661) is constructed as part of a wheel (analogous to wheel 22 of the Siddiqui patent '661). The devices outlined in U.S. Pat. No. 6,285,355 to Chang and U.S. Pat. No. 5,808,568 to Wu combines at least part of the detent mechanism with the encoder disc and the wheel (analogous to grooves 40, ratchet 42, encoder disc 44, and wheel 20 of the Siddiqui patent '661) to generate one integral unit.

Other button-wheel variations involve different switch actuation actions. For example, U.S. Pat. No. 5,473,344 to Bacon et al. describes another tilting-shaft switch actuation method in which an additional slotted shape is utilized, and U.S. Pat. No. 5,446,481 to Gillick et al. discloses an hourglass-shaped wheel that tilts about its center to actuate switches located under either side of the hourglass-shaped wheel. These alternative tilting-shaft devices are more complex and require more components than the device presented in Siddiqui patent '661.

In addition to the tilting switch actuation action, alternatives that include semi-tilting switch actuation mechanisms also exist. Both U.S. Pat. No. 6,246,392 to Wu and U.S. Pat. No. 6,188,389 to Yen disclose button-wheels in which the two bearings supporting the wheel shaft include slotted shapes that have slots which help guide the motion of the wheel shaft; the devices disclosed in the Wu patent '392 and the Yen patent '389 bias the wheel shaft toward the user with one single spring located on one side of the wheel. The Merminod patent describes a different system that utilizes only one slotted shape; the end of the wheel opposite to the slotted shape is attached to a formed spring, and can move in a manner limited by the deflection of the spring. Since all three of the Wu patent '392, the Yen patent '389, and the Merminod patent '369 teach biasing the wheel toward the user on only one side of the wheel, a torque results when the user pushes on the wheel of any of these disclosed devices, and significant tilting of the wheel occurs. Thus, the action associated with these switch actuation inputs combines tilting as well as translation, and can be considered semi-tilting.

Minimally-tilting switch actuation mechanisms also exist. For example, U.S. Pat. No. 6,292,113 to Wu (Shown in FIG. 2), U.S. Pat. No. 6,285,355 to Chang, U.S. Pat. No. 6,188,393 to Shu, U.S. Pat. No. 5,530,455 to Cillick et al., and older Microsoft® INTELLIMOUSE all disclose button-wheels in which the entire wheel mounting moves to achieve switch actuation. In order to enable the movement of the entire mounting, these devices tend to be larger, more complex, and more costly than the device of the Siddiqui reference. In the devices disclosed by the Wu patent '113, the Chang patent '355, and older INTELLIMOUSE, these wheel mountings are biased toward the user by one spring located on one side of the wheel. In contrast, in Gillick '455's and Shu '393's devices, the mountings are biased toward the user on both sides of the wheel. With biasing forces on both sides of the wheel, where user push-type forces are applied, the wheel mounting can respond to user push-type force with motion that is more translation than tilting. With this substantially translational motion, in which translation is the primary action of switch actuation, it is possible to produce tactile force and displacement responses that are more uniform across the width of the wheel. However, this additional biasing force usually increases the size, complexity, and cost of the mechanism beyond that associated with a single biasing force as will be explained later in the disclosure.

Despite these numerous button-wheel designs, the general tilting-shaft button-wheel idea and configuration described by Siddiqui is still currently the most popular commercial button-wheel embodiment. This is largely because button-wheels are mostly used in mice, and the Siddiqui device is a low-cost and low-complexity device that satisfies mouse design criteria.

Mice have minimal space constraints, since they must be at least a minimum external size for ergonomic reasons. This external size leads to internal spaces that are typically much larger than necessary to accommodate the sensors, structures, mechanisms, and electronics associated with conventional mouse features. Faced with this minimal space constraint, conventional mice have focused on minimizing cost and complexity instead of size. Thus, the internal components of mice are usually larger, cheaper, and easier to assemble than those found in more space-constrained input devices, such as PDA touch screens, laptop pointing sticks, and computer touchpads. This minimal space constraint has also affected the development focus of button-wheels in prior art devices. Siddiqui's device, along with the variations described above, focus on reducing the cost and complexity of the button-wheel, often at the trade-off of increased mechanism size.

Mice also have relatively minimal constraints on uniform displacement and force feedback to the user, which makes tilting and semi-tilting button-wheel devices viable devices. Tilting and semi-tilting systems provide varying displacement and force feedback across the width of the wheel; the wheel shaft acts as a lever arm about the center of tilt and scales the force and displacement feedback as dictated by geometry. However, since the width of the wheel is small compared to its lever arm, the differences in force and displacement tactile feedback along the width of the wheel are small and almost unnoticeable to the user. These minimal uniform feedback constraints have enabled mouse button-wheels to utilize simpler mounting designs and fewer components than if uniform feedback were required.

Unlike mouse button-wheels, many input devices must provide uniform force and displacement feedback. For example, some computer keyboards contained space bars that tilted about their centers. These space bars were unsatisfactory, since they were long enough such that the non-uniform feedback across the width of the space bar were noticeable to the user—some of these space bars even jammed when they were depressed on their left or right edges. In response, keyboard makers introduced a host of different linkages and mechanisms to ensure uniform feedback across the width of the space bar, and space bars that tilted about the center are no longer used.

Although the above observations have highlighted computer mice because button-wheels are most often found in mice, the same observations also apply to any device similar to mice in terms of size and feedback constraints. Examples of such devices include, but are not limited to, trackballs, handheld videogame control pads, and joysticks. However, these minimal constraints on size and feedback will not always apply. For example, as computer mice and similar devices grow in complexity to incorporate features such as wireless communications and force feedback, space constraints will grow tighter.

Existing devices such as Personal Digital Assistants (PDA) and laptops also have very tight—especially height to reduce the overall thickness of the PDA or laptop-space constraints. In addition, devices such as PDAs and laptops may best be served by button-wheels with wider wheels and lower ratios of wheel diameter to wheel width and shaft length to wheel width. These lower ratios help the button-wheels meet tighter space constraints and allow users to manipulate the button-wheels in more ways. Unlike button-wheels for mice, which are usually manipulated by one or two dedicated digits, button-wheels for PDAs and laptops may be located where users can access them with thumbs, multiple fingers, or either hand.

These lower ratios of wheel diameter to wheel width and shaft length to wheel width also mean tighter feedback requirements that make tilting and semi-tilting designs much less desirable. With these lower ratios, a tilting or semi-tilting design would yield a greater difference in force and displacement feedback along the width of the wheel than a similar design targeted for mice. This difference may be noticeable and disturbing to users. At an extreme case for a tilting shaft system, the user may not be able to actuate the button near the center of tilt, or may jam the button-wheel at the end opposite that of the center of tilt. These failure modes are similar to those of space bars that tilted about their centers, and accentuate the importance of uniform force and displacement response in button systems where the component that interacts with the user is relatively wide.

Button-wheels utilizing tilting or semi-tilting designs have a further disadvantage in that they usually need to accommodate a vertical travel height that is greater than that traveled by the wheel during switch actuation. The actual difference is dependent on the lengths of the lever arms from the center of pivot to the wheel and to the farthest pivoting or semi-pivoting point. For example, in a design with a tilting-shaft approach and a wheel mounted equidistant between two bearings, the vertical distance traveled by the section of the shaft within the bearing that does not function as the fulcrum is approximately twice that of the wheel. Mounting the wheel at the section of the shaft that travels the greatest distance during the tilting or semi-tilting switch actuation action (typically one of the end sections of the shaft) may reduce the motion that must be accommodated by the button-wheel during switch actuation. However, this approach also introduces undesirable characteristics associated with a cantilevered-wheel system.

The ideal button-wheel for this set of design criteria associated with applications similar to PDAs and laptops is one that minimizes size (especially height), ensures that no parts of the button-wheel need to travel more than the wheel during switch actuation, and provides uniform force and displacement feedback to the user during switch actuation. The ideal button-wheel also minimally increases the complexity and cost of the button-wheel.

Some prior-art devices do attempt to address some of the tighter space constraints, but they still utilize tilting as the main switch actuation mechanism. For example, U.S. Pat. No. 6,198,057 to Sato et al. (Shown in FIG. 3) and U.S. Pat. No. 6,194,673 to Sato et al. both shrink a tilting-shaft design by utilizing smaller parts and integrating multiple components into one mechanism; for example, the device of Sato '057 uses smaller mechanical and electrical components, removes the biasing spring and uses the switch as the biasing agent, replaces the optical wheel encoder with a mechanical one, and combines the mechanical encoder, detent, and bearing into one integral part.

Even though these two devices of Sato '057 and Sato '673 do shrink the size of the button-wheel noticeably, they do not address the shortcomings of a tilting or semi-tilting mechanism as outlined above. Both devices by Sato '057 and Sato '673 must be tall enough to accommodate the greater vertical distance traveled by the end of the shaft opposite from the center of tilt, which is greater than the actual vertical distance traveled by the wheel. In addition, these systems still have an inherently nonuniform tactile response across the width of the wheel.

Another button-wheel design that attempts to fit within the tighter space constraints is U.S. Pat. No. 6,211,474 to Takahashi. Takahashi's device is similar to the tilting-shaft design described by the Siddiqui patent'661with one exception. The wheel can tilt about the center of the wheel shaft as well as tilt about one of the bearings. Takahashi's device has the same deficiencies as both of the devices outlined by Sato '057 and Sato '673, and is more complex and even less uniform in tactile response to accommodate the additional degree of wheel tilt freedom about the center of the shaft.

A device that attempts to fit within the tight space constraints and does not use shaft tilt to actuate the button is U.S. Pat. No. 6,218,635 to Shigemoto et al. (Shown in FIG. 4). Shigemoto '635 describes a mechanism in which the entire wheel mounting is located above a switch. When the user pushes on the wheel, the entire wheel mounting tilts about an external axis distinct from and parallel to the wheel axis to actuate the button of the switch. Although this configuration means that the button-wheel only has to accommodate the vertical travel of the wheel, having a moving mounting still results in a larger overall size and probably greater complexity than that associated with a stationary mounting and moving shaft. In addition, the Shigemoto device must also accommodate some horizontal motion of the mounting that is associated with the mounting tilt.

No button-wheel currently exists that fulfills all the design constraints associated with devices such as PDAs and laptops, where tight spaces and uniform tactile feedback are highly desirable. Existing devices hold onto ideas that are more applicable to computer mice, contain features that increase the size of the button-wheel, or introduce more complex and costly mechanisms. The present invention addresses the deficiencies of these prior art approaches.

SUMMARY

The disclosure describes a button wheel. The button wheel comprises a support frame including a pair of parallel opposed inner surfaces. A platform is nestably mounted in the support frame. The platform includes a pair of parallel opposed outer surfaces forming a pair of linear bearings with the parallel opposed inner surfaces of the support frame to allow the platform to translate from a biased rest position in a direction parallel to the opposed inner surfaces and the opposed outer surfaces. The button wheel also includes first and second spaced apart mounts fixed to one of the support frame and said platform. The button wheel includes a shaft disposed along an axis and including a first end rotatably engaged in the first mount and a second end rotatably engaged in the second mount. A wheel is mounted on the shaft and a rotation sensor is in operative communication with the wheel. The button wheel also includes a translation sensor coupled between the support frame and the platform.

The disclosure also describes an alternative embodiment of the button wheel. This embodiment comprises a support frame including a flat-spring region and a first mount disposed on the flat-spring region of the support frame. The button wheel includes a second mount spaced apart from the first mount and disposed on the support frame. A translation sensor is mounted in a fixed position with respect to the fixed region of the support frame. The button wheel also includes a shaft disposed along an axis and including a wheel mounted on the shaft and a first end rotatably engaged in the first mount and a second end rotatably and translatably engaged in the second mount so as to allow the shaft to translate with respect to the support frame in a direction substantially perpendicular to the axis to actuate the translation sensor upon the application of mechanical force to the wheel having a component substantially along the direction. The button wheel has a rotation sensor in operative communication with the wheel.

Another button wheel embodiment is described in the disclosure. The button wheel comprises a support frame and first and second spaced apart mounting members mounted to the support frame. A shaft is disposed along an axis and including a first end rotatably engaged in the first mounting member and a second end rotatably engaged in the second mounting member. A first translation limiter is disposed on the shaft proximate to the first end and adjacent to the first mounting member to limit the translation of the shaft along the axis. A second translation limiter is disposed on the shaft proximate to the second end and adjacent to the second mounting member to limit the translation of the shaft along the axis. A wheel is mounted on the shaft and a rotation sensor is in operative communication with the wheel. The button wheel includes a translation sensor coupled between the support frame and the shaft.

Another embodiment is described comprising a support frame and first and second biasing members mounted on the support frame. The button wheel includes first and second spaced apart movable mounting members mechanically coupled to the support frame through the first and the second biasing members. A shaft is disposed along an axis and includes a first end rotatably engaged in the first movable mounting member and a second end rotatably engaged in the second movable mounting member. A wheel is mounted on the shaft. A rotation sensor is in operative communication with the wheel and a translation sensor is coupled between the support frame and the shaft.

BRIEF DESCRIPTION OF THE DRAWINGS

Referring now to the figures, wherein like elements are numbered alike.

DETAILED DESCRIPTION

Those of ordinary skill in the art will realize that the following description of the present invention is illustrative only and not in any way limiting. Other embodiments of the invention will readily suggest themselves to such skilled persons.

FIGS. 5 through 13 outline a preferred embodiment in which biasing members interact with the platform (either by direct physical contact or through other components that support the platform) to bias the platform, shaft, and wheel and ensure substantial translation of these three components and uniform tactile feedback along the width of the wheel in response to push-type force on the wheel along the direction indicated by F. Substantial translation is translation that is substantially parallel to the direction F and having a minimal tilt or deviation from the direction F. This preferred embodiment can utilize any type of rotary encoder that is commercially available as a first sensor, or simply a rotation sensor 102 that senses the rotation of the wheel, and a second sensor, or simply a translation sensor that senses the translation of the wheel created by user push-type forces on the wheel along the direction F. Similarly, if tactile feedback in response to rotation of the wheel is desired, this preferred embodiment can utilize any type of tactile feedback mechanism similar to those found in commercially available button-wheels. One example is to employ a component that combines a mount, a rotary encoder, and a detent mechanism into one unit that reduces or limits shaft tilt.

Figure 1:
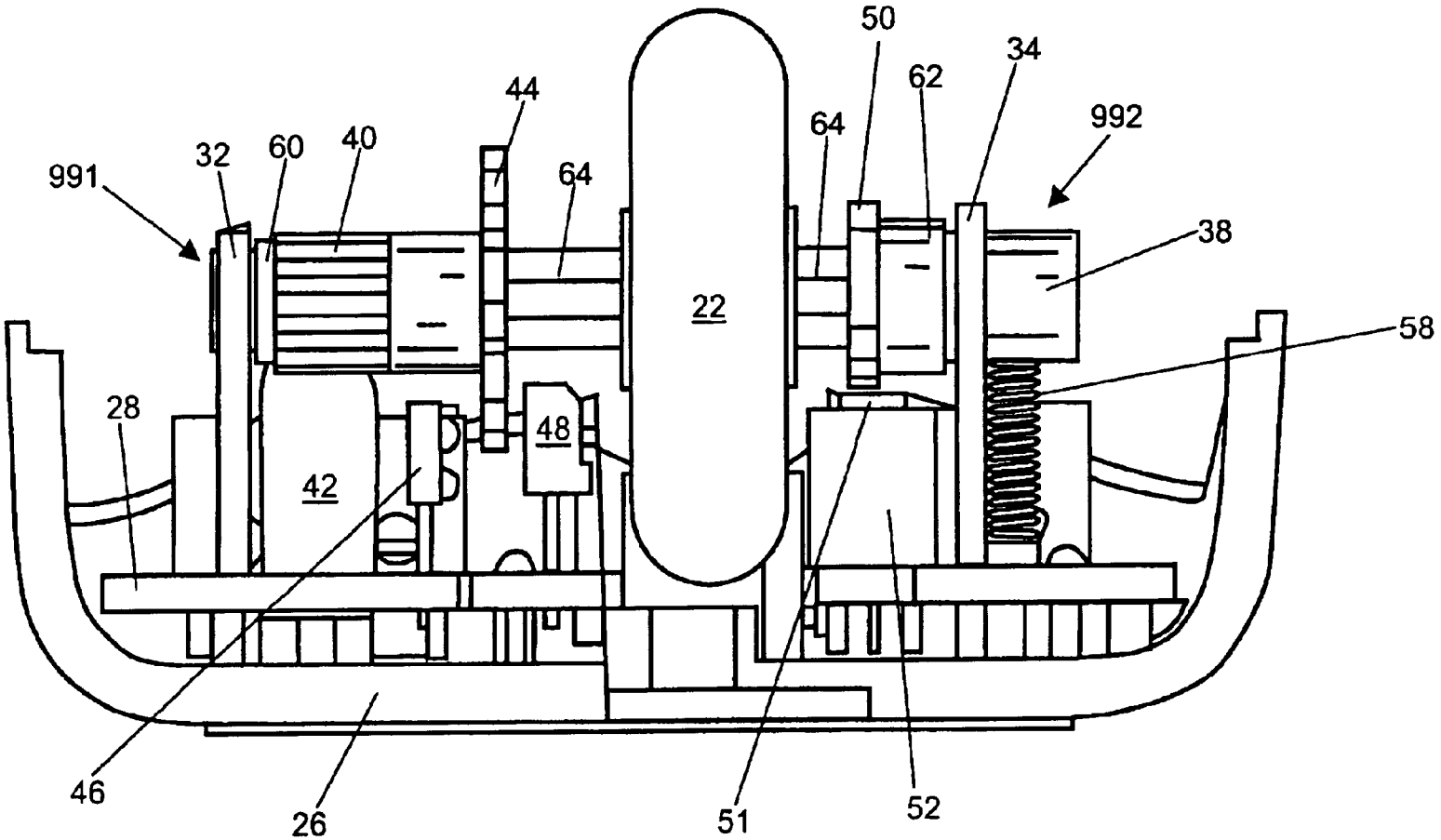
FIG. 1 PRIOR ART
FIG. 1 is a partial cut-away view of a prior art button-wheel design for computer mice.
Figure 2:
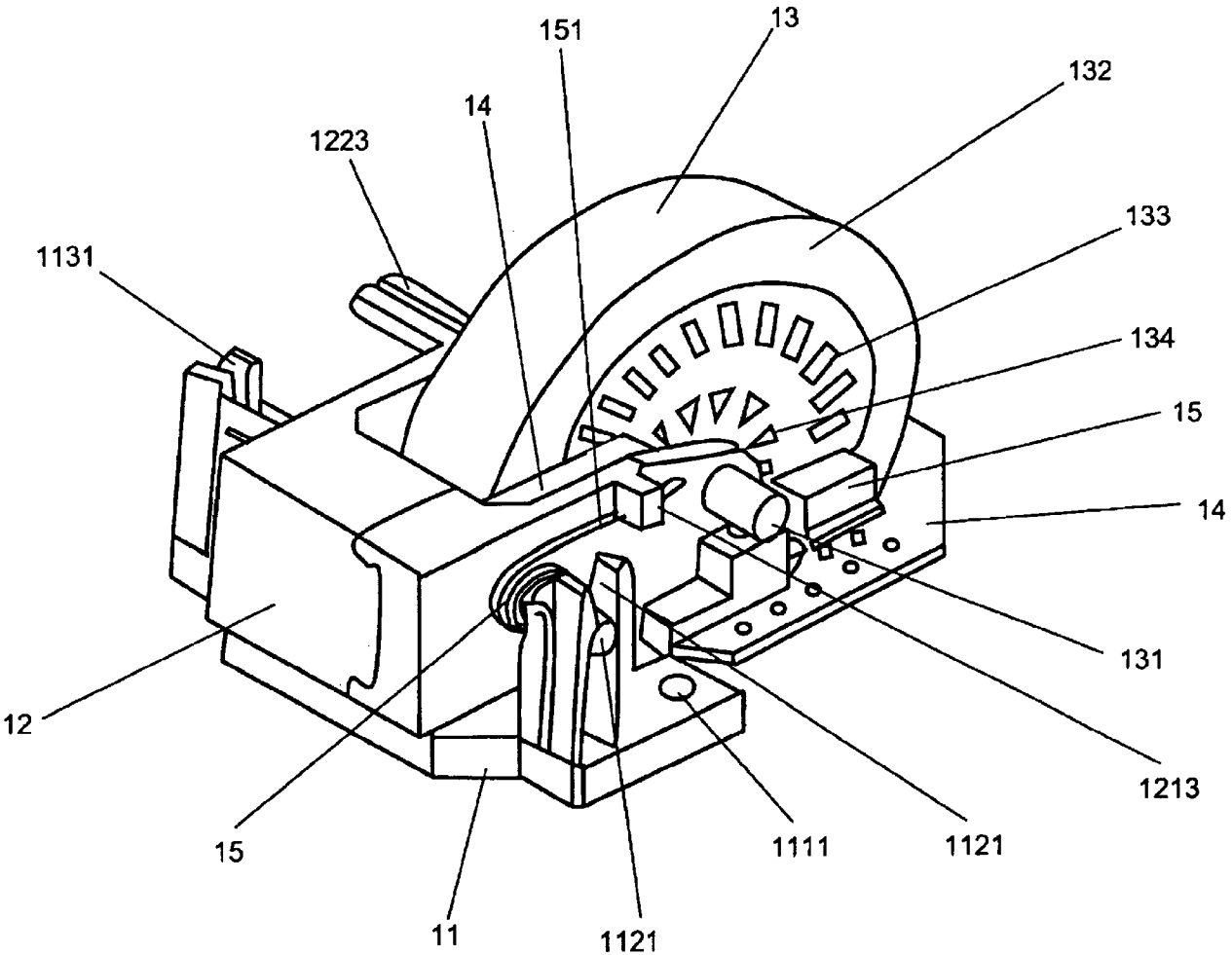
FIG. 2 PRIOR ART
FIG. 2 is an isometric view of a prior art button-wheel design used in computer mice.
Figure 3:
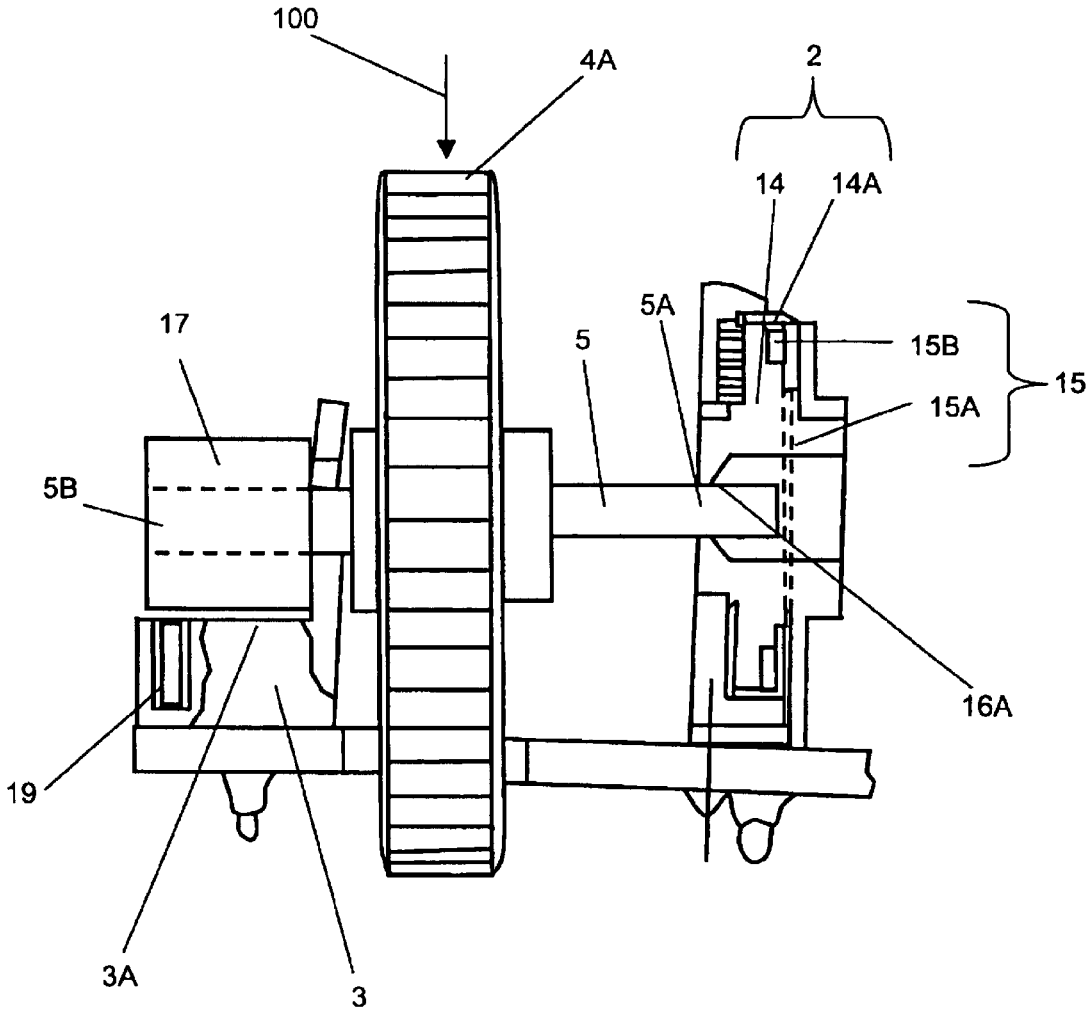
FIG.3 PRIOR ART
FIG. 3 is a partial cross-sectional view of another prior art button-wheel design that incorporates a tilting shaft to actuate a switch.
Figure 4:
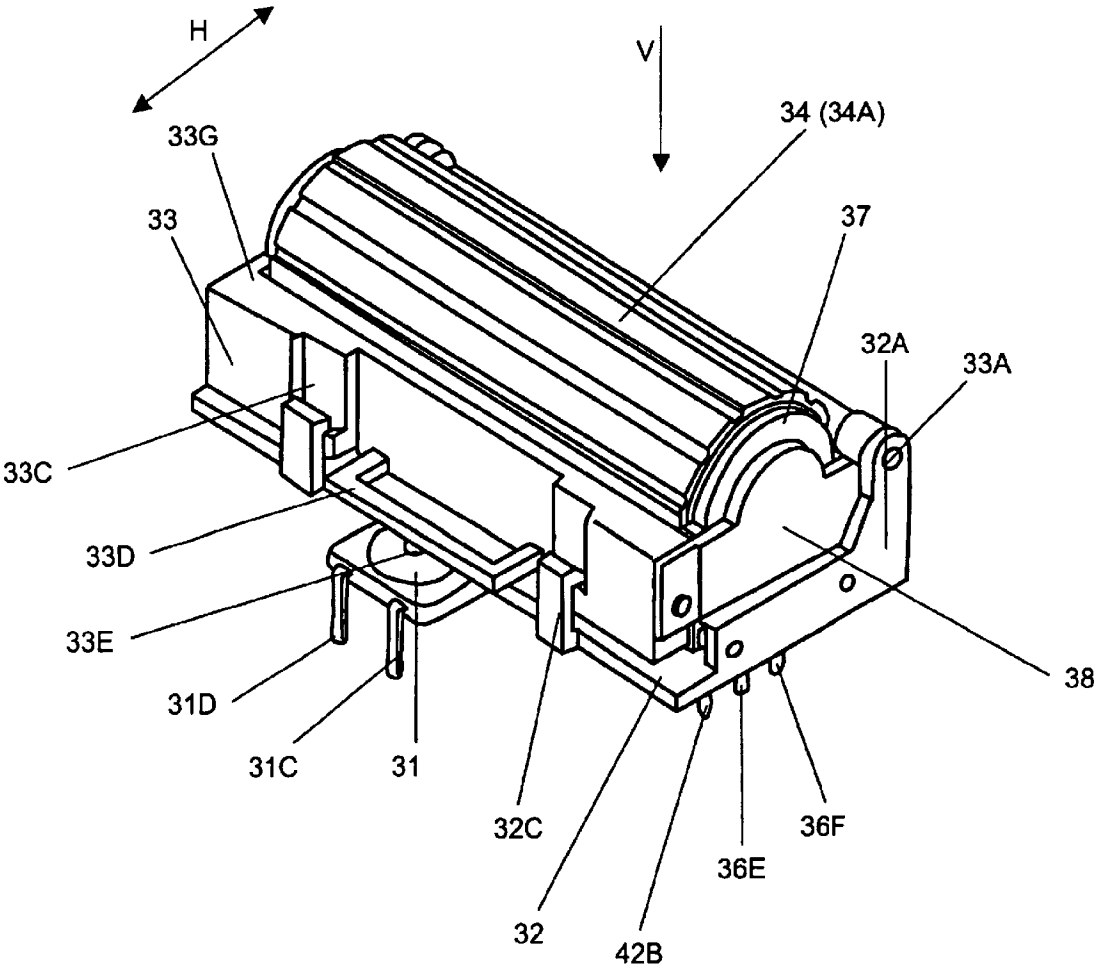
FIG. 4 PRIOR ART
FIG. 4 is an isometric view of a prior art button-wheel design in which the platform tilts about an axis external to the wheel and parallel to the wheel axis to actuate a switch.
Figure 5:
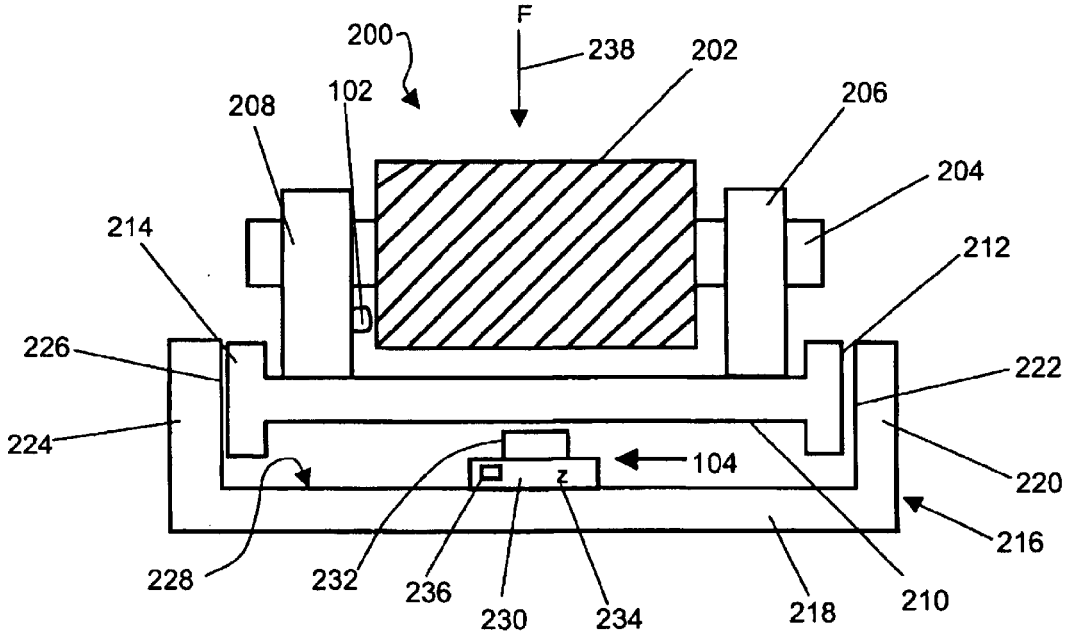
FIG. 5 is a cross-sectional view of an exemplary embodiment of a button-wheel that actuates a switch through translation of the platform.

Referring to FIG. 5, a cross-sectional view of an exemplary embodiment of a button-wheel 200 is illustrated. The button-wheel 200 includes a wheel 202 having a generally cylindrical shape in which the width dimension is larger than the diameter dimension. It is contemplated that variations of dimensions and shape of wheel 202 are within the scope of the disclosure. The button-wheel 200 includes a shaft 204. The shaft 204 can be an axial extension of the wheel 202 wherein the shaft 204 has a smaller diameter than that of the wheel 202. The shaft 204 and wheel 202 can also have the same diameter, such that the wheel 202 is simply a defined region of the shaft 204. Wheel 202 is supportable by at least one mount or in a preferred embodiment, two mounts, a first mount 206 and a second mount 208. The first mount 206 and the second mount 208 provide rotational and translational support for wheel 202 through shaft 204. Any combination of mount types is contemplated as part of this disclosure.

The first mount 206 and second mount 208 are mounted to a platform 210. Platform 210 can be a structure that provides a substantially rigid surface to attach the first mount 206 and the second mount 208, as well as minimize shaft 204 binding with first mount 206 and second mount 208, due to platform deflection relative to shaft 204. Additionally, platform 210 can provide sufficient stiffness such that translational forces applied to wheel 202 can be transmitted from wheel 202 through shaft 204 into first mount 206 and second mount 208, and into platform 210. Platform 210 includes at least a first outer surface 212. In another embodiment, platform 210 includes two opposed outer surfaces, a first outer surface 212 and a second outer surface 214. The first outer surface 212 and second outer surface 214 are located at opposite ends of the platform 210. The first outer surface 212 and second outer surface 214 are located substantially parallel to and on opposite sides of the platform 210.

Further included with the button-wheel 200 is a support frame 216. The support frame 216 includes multiple surfaces that enclose and support the platform 210. The support frame 216 includes a base 218 and at least two sides, a first side 220 having a first inner surface 222 and a second side 224 having a second inner surface 226. The sides 220 and 224 protrude from the base 218 substantially perpendicular to a planar base surface 228 formed by the base 218. The sides 220 and 224 are affixed on opposite ends of the base 218. The first outer surface 212 and the second outer surface 214 of the platform 210 are located within the button-wheel 200 such that the first inner surface 222 and the second inner surface 226 guide the first outer surface 212 and the second outer surface 214. Located between the base 218 and the platform 210 is one type of translation sensor in the form of a push button switch 230. The switch 230 includes a button 232 disposed on the switch 230. The switch 230 includes a biasing member 234 that biases the button 232 and in some embodiments the platform 210 and associated button-wheel components and subcomponents. Also included within the button 232 is a button sensor 236. The operational relationship of the components and subcomponents of the button-wheel 200 can be further explained below.

FIG. 5 depicts an embodiment of a button-wheel 200 in which the switch 230 combines the functions of sensing translation and biasing, via the button sensor 236 that senses user push-type inputs on the wheel 202 and the biasing member 234, respectively. Switch 230, shown in one of many embodiments as a pushbutton switch, having the button 232 and biasing member 234 that can produce spring-like reaction forces in response to translation of the platform 210 along a direction F indicated by the force direction arrow 238. When a user of the button-wheel applies a push-type force on the wheel 202 along the direction shown by F 238, this user force is transmitted through the shaft 204 to the first mount 206 and second mount 208. Mounts 206 and 208 are designed to minimize the tilting of shaft 204, and transmit the user force toward the platform 210. Motion of platform 210 is guided by the sides 220 and 224 of the support frame 216 to translate along the direction shown by direction arrow 238. The push-type force on wheel 202 causes platform 210 to substantially translate along the direction shown by direction arrow 238, with minimal tilt or deviation therefrom towards the base 218 of support frame 216. Platform 210 normally rests on or near button 232. A downward motion of platform 210 depresses button 232 and actuates switch 230. The button-wheel configuration shown in FIG. 5 thus biases and guides platform 210 such that translation is the primary action associated with switch actuation. Button 232 and biasing member 234 provide the tactile displacement and force feedback associated with switch actuation, and limit the total possible travel of wheel 202 by limiting the total possible travel of platform 210. Additional features or components that function as biasing members or hard stops can be added to the button-wheel 200 shown in FIG. 5 to further refine the feel and limit of the travel associated with switch actuation.

Figure 6:
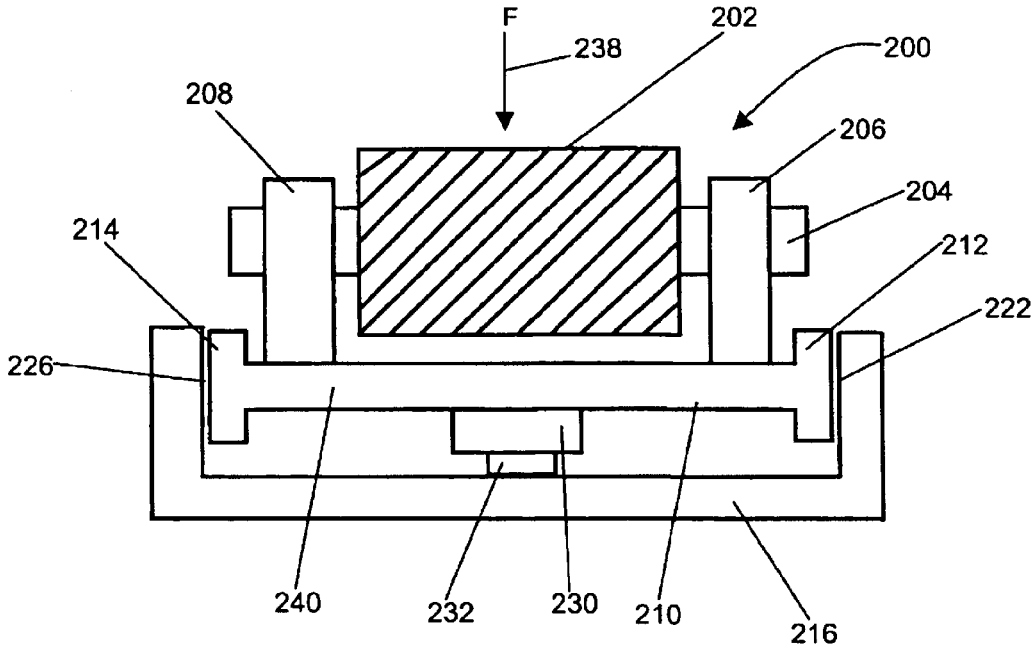
FIG. 6 is a cross-sectional view of a button-wheel that actuates a switch through translation of the platform.

The components of the current embodiment can be located and oriented in alternative configurations as shown in FIG. 6, to lower cost and complexity of the button-wheel device. For example, in an embodiment in which platform 210 is a circuit board with conductive traces 240 that facilitate the acquisition and transmission of button-wheel signals, switch 230 can be mounted on the side of platform 210 opposite from wheel 202. The button 232 is adjacent and in contact with planar base surface 228. When the user applies push-type force on wheel 202 along the direction shown by direction arrow 238, platform 210 substantially translates toward support frame 216 and depresses button 232 of switch 230 against base 218 and actuates switch 230. Such a configuration, which is shown in FIG. 6, enables the designer to place switch 230 in direct electrical communication with the conductive traces 240 through surface mount technology, via technology, through-hole technology, or other means if necessary while incurring only negligible changes in the button actuation process or feel. User rotational inputs to wheel 202 can be accomplished without creating substantial translation of platform 210.

In the embodiment of the button-wheel 200 shown in FIGS. 5 and 6, the outer surfaces 212 and 214 of platform 210 and first inner surface 222 and second inner surface 226 of support frame 216 function as linear bearings. Thus, the tolerances between the first outer surface 212 and first inner surface 222 and the second outer surface 214 and second inner surface 226 are preferably tightly controlled to minimize chances of binding and sticking and to ensure uniform tactile feedback. Maintaining uniform feedback means that similar displacement and force feedback are produced regardless of where along the width of wheel 202 the user applies push-type force along the direction shown by direction arrow 238. Those skilled in the art will note that if button 232 has a larger area of contact with platform 210, or if outer surfaces 212 and 214 are increased in size to improve alignment precision and to facilitate the interaction between mounting 210 and support frame 216, then the tolerances between outer surfaces 212 and 214 and inner surfaces 222 and 226 can be made greater.

FIGS. 7 through 13 depict alternative embodiments for the components and features of the button-wheel 200 that are located as depicted below platform 210, including platform 210. Components and features of the button-wheel 200 depicted above platform 210, such as wheel 202, remain unchanged as depicted in FIG. 5 and thus are not explicitly shown in FIGS. 7 to 13.

Figure 7:
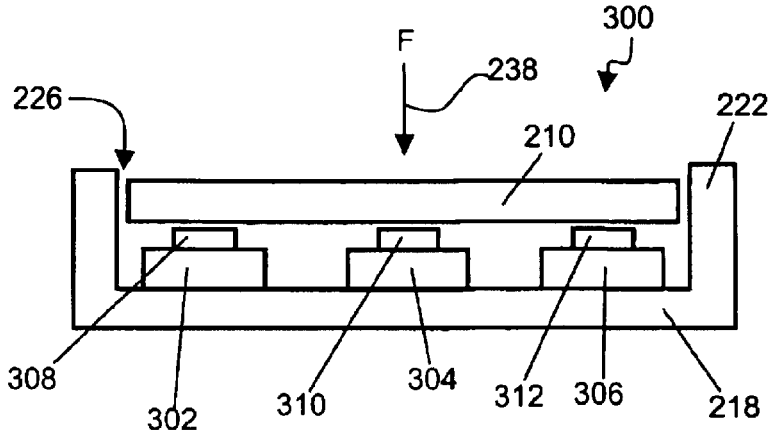
FIG. 7 is a cross-sectional view of an alternate embodiment for the bottom section of the exemplary embodiment depicted in FIGS. 5 and 6.

FIG. 7 illustrates an embodiment of button-wheel 300 where platform 210 is supported by multiple switches, switch 302, switch 304, and switch 306, each switch having buttons. Switch 302 having button 308, switch 304 having button 310, and switch 306 having button 312. Each switch and button also has a biasing member and sensor (not shown). The biasing members can provide spring-like reaction forces in response to platform 210 translation along the direction shown by direction arrow 238. Switches 302, 304, and 306 are selected and located such that, when the user applies push-type force on wheel 202 (not shown) along the direction shown by direction arrow 238, platform 210 substantially translates and pushes buttons 308, 310, and 312 and actuate switches 302, 304, and 306. Those skilled in the art will note that, if biasing members associated with switches 302, 304, and 306 provide similar force and displacement reaction in response to translation of platform 210 along the direction shown by direction arrow 238, locating them symmetrically about the expected center of user push-type force application locations and close to inner surfaces 202 and 212 helps to ensure that platform 210 will substantially translate along the direction shown by direction arrow 238. The location will also ensure that platform 210 will minimally deviate from the direction F (tilt), in response to push-type force along the direction shown by direction arrow 238 even when such user push-type force is applied near a portion of wheel 202 closer to switch 302, and farther from switch 304, or switch 306. These multiple locations of support help ensure substantial translation also make it possible for the tolerances between outer surfaces 212 and 214 of FIG. 5 and inner surfaces 222 and 226 to be greater than required by the configurations shown in FIGS. 5 and 6.

In another embodiment, only one of the switches 302, 304, and 306 has to be powered and connected to the button-wheel electronics (not shown) to achieve ON/OFF switch functionality. Any of the other two switches, if also powered and in electrical communication with the button-wheel electronics, can serve as a backup switch. If the other two switches are not powered and are not in electrical communication with the button-wheel electronics, then they can be dummy switches that function only as biasing members that help ensure substantial translation and provide uniform tactile feedback.

Figure 8:
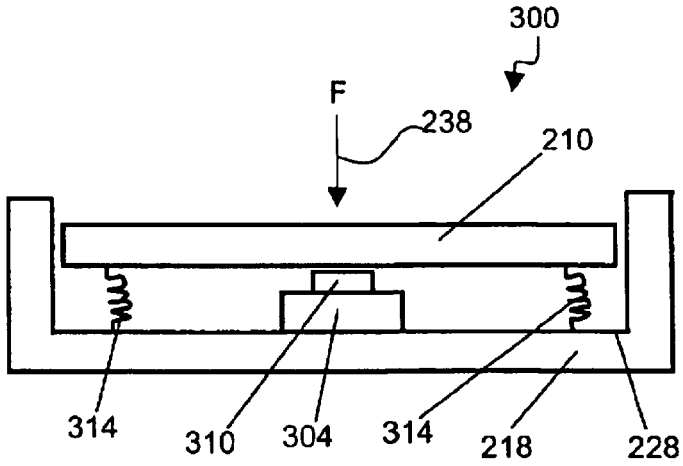
FIG. 8 is a cross-sectional view of an alternate embodiment for the bottom section of the exemplary embodiment depicted in FIGS. 5 and 6.

To help ensure substantial translation and uniform tactile feedback for the simple embodiment shown in FIG. 8, compressive biasing members 314 are shown substituted for the switches 302 and 306 mountable between the platform 210 and the base 218 on the planar base surface 228. The biasing members 314 can produce spring-like reaction forces similar to that of the switch 304. The biasing members 314 may consist of any component and material able to produce spring-like responses in response to push-type inputs transmitted through the platform 210, (for example, unpowered switches, coils, snap domes, compression springs, extension springs, torsion springs, flat springs and elastomeric bumps).

Figure 9:
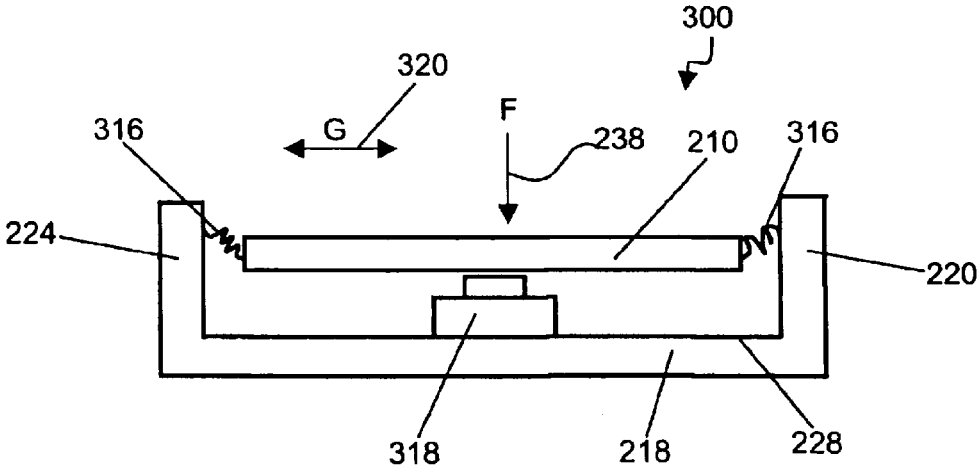
FIG. 9 is a cross-sectional view of an alternate embodiment for the bottom section of the exemplary embodiment depicted in FIGS. 5 and 6.

FIG. 9 shows another embodiment including tensile biasing members 316 in which the tensile biasing members 316 are mountable to the platform 210 at ends near the first side 220 and the second side 224 of the base 218. A switch 318 is mountable between the platform 210 and the base 218 on planar base surface 228. In an embodiment the switch 318 is one pushbutton switch. This embodiment allows limited translation of the platform 210 in the directions indicated by G and the bi-directional arrow 320, which may be desirable in some button-wheel designs. Those skilled in the art will note that, to ensure substantial translation of platform 210 along the direction shown by direction arrow 238 in response to user input forces along the direction shown by direction arrow 238 in the configuration shown in FIG. 9, biasing members 316 may need to be biasing members that generate spring-type reactions different from switch 318 in response to the same input force vector.

Figure 10:
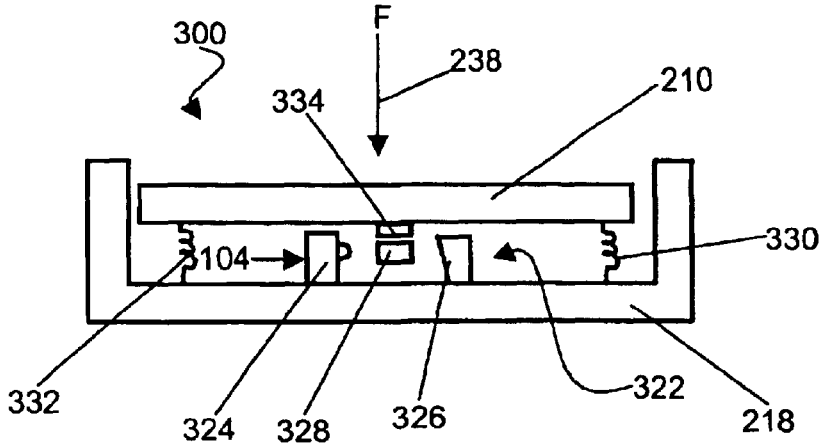
FIG. 10 is a cross-sectional view of an alternate embodiment for the bottom section of the exemplary embodiment depicted in FIGS. 5 and 6.

FIG. 10 shows another embodiment that utilizes a breakbeam sensor 322 for second sensor 104. The breakbeam sensor 322 is a second sensor variation that utilizes an alternate technology that does not also function as a biasing member. The breakbeam sensor 322, which is an optical beam-breaking type sensor formed from a photo-emitter 324 and photo-detector 326 fixed to the base 218, is non-contact and does not provide any spring-type reaction forces. During operation of the breakbeam sensor 322, emitter 324 transmits photons that are sensed by detector 326, and they function together to determine the presence or non-presence of a blocking piece 328 extending from platform 210. Blocking piece 328 can be designed such that the length that extends beyond the platform 210 is short enough to allow detector 326 to detect photons emitted by emitter 324 when the platform 210 is in a normally non-translated position. When the user pushes with a force along the direction shown by direction arrow 238, the movement of platform 210 causes blocking piece 328 to interpose between detector 326 and emitter 324; this prevents detector 326 from sensing the photons from emitter 324, and results in a change in the state of the detector signals that indicates switch actuation. Two biasing members 330 and 332 which support platform 210 are preferably similar in spring response and placed in a geometrically symmetrical manner to help ensure substantial translation of platform 210 and uniform tactile and displacement feedback in response to user push-inputs on wheel 202 along the direction shown by direction arrow 238.

It is also within the scope of this disclosure to design blocking piece 328 to normally obstruct emitter 324 and detector 326, and move into a non-blocking state with sufficient user input force along the direction shown by direction arrow 238. This latter approach may be best accomplished by incorporating a passage 334 or cutout in blocking piece 328. The passage 334 or cutout can be placed close to platform 210 such that blocking piece 328 obstructs communication between photo emitter 324 and photo detector 326 when there is no translation of the platform 210 along the direction shown by direction arrow 238. Then, with sufficient user input force along the direction shown by direction arrow 238, the substantial translation of platform 210 brings the passage 334 into place between emitter 324 and detector 326 such that blocking piece 328 no longer prevents detector 326 from sensing the photons of emitter 324. Those skilled in the art will also note that a passage or cutout in blocking piece 328 can also be used in the embodiment where blocking piece 328 normally does not obstruct emitter 324 and detector 326. In this embodiment, the passage 334 can be located such that the photo emitter 324 and detector 326 can optically communicate when there is no translation of the platform 210 along the direction shown by direction arrow 238. Sufficient user input force along the direction shown by direction arrow 238 translates platform 210 and removes passage 334 from alignment between emitter 324 and detector 326 such that optical communication is broken between emitter 324 and detector 326. The translated platform 210 places the passage 334 into a position such that blocking piece 328 prevents detector 326 from sensing the signals of emitter 324. User rotational inputs to wheel 202 can be accomplished without creating substantial translation of platform 210.

Figure 11:
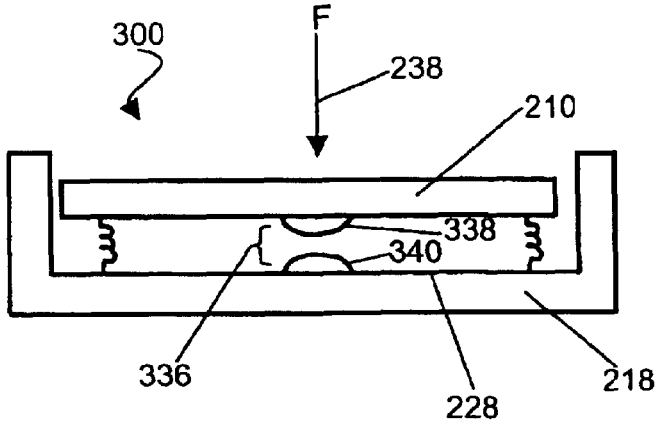
FIG. 11 is a cross-sectional view of an alternate embodiment for the bottom section of the exemplary embodiment depicted in FIGS. 5 and 6.

Although the embodiment depicted in FIG. 10 explicitly calls out a beam-breaking type sensor as the alternative switching technology used, other switching technologies can also be incorporated into the button-wheel 300. For example, FIG. 11 illustrates a proximity sensor 336 utilized as a translation sensor for another embodiment of the button-wheel 300. The proximity sensor 336 can include a first sensor member 338 and a second sensor member 340.

The first sensor member 338 can be fixed to platform 210 and located opposite from second sensor member 340, which is fixed to planar base surface 228 of base 218. The proximity sensor 336 senses the movement of platform 210 relative to base 218, in response to user push-type inputs on wheel 202 (not shown) along the direction shown by direction arrow 238. A thresholding algorithm can be used in conjunction with the outputs of the proximity sensor 336 to generate appropriate switching signals.

Figure 12:
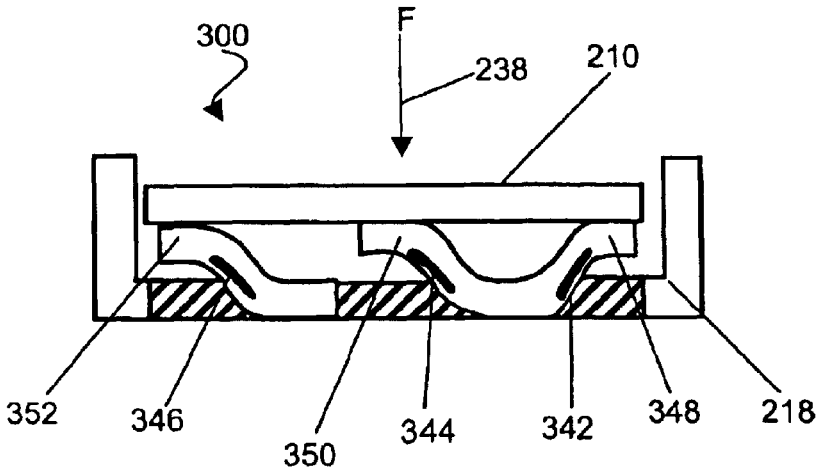
FIG. 12 is a cross-sectional view of an alternate embodiment for the bottom section of the exemplary embodiment depicted in FIGS. 5 and 6.

FIG. 12 shows strain gauges 342, 344, and 346 as another potential technology for another embodiment of the second sensor. FIG. 12 shows an embodiment in which three second sensors are formed by strain gauges 342, 344, and 346. The strain gauge 342 is disposed on biasing member 348 that is mounted to base 218. The strain gauge 344 is disposed on biasing member 350 that is mounted to base 218. The strain gauge 346 is disposed on biasing member 352 that is mounted to base 218. The biasing members 348, 350 and 352 can, for example, be flat springs that deform and deflect in reaction to forces from platform 210. Biasing members 348, 350 and 352 extend from base 218 and support platform 210. These biasing members 348, 350 and 352 are preferably designed and located to help ensure substantial translation of platform 210 in response to user push-type inputs on wheel 202 (not shown) along the direction shown by direction arrow 238. When push-type inputs are applied, platform 210 compresses biasing members 348, 350, and 352 such that strain gauges 342, 344, and 346 change in resistance. This change in resistance can be sensed and used to provide the signals associated with switch actuation of the button-wheel 300. In an alternate embodiment, strain gauges 342, 344, and 346 are embedded within biasing members 346, 350, and 352, respectively. In an alternate embodiment, only one or two of the strain gauges 342, 344, and 346 and associated biasing member 348, 350, and 352 respectively are used by button-wheel 300. In an alternate embodiment, additional biasing members comprise button-wheel 300. Although FIGS. 10, 11 and 12 depict only three potential alternatives to conventional switches that can be used for the second sensor, those skilled in the art will note that many other alternative technologies, such as load cells, are viable and are contemplated as part of this disclosure.

Figure 13:
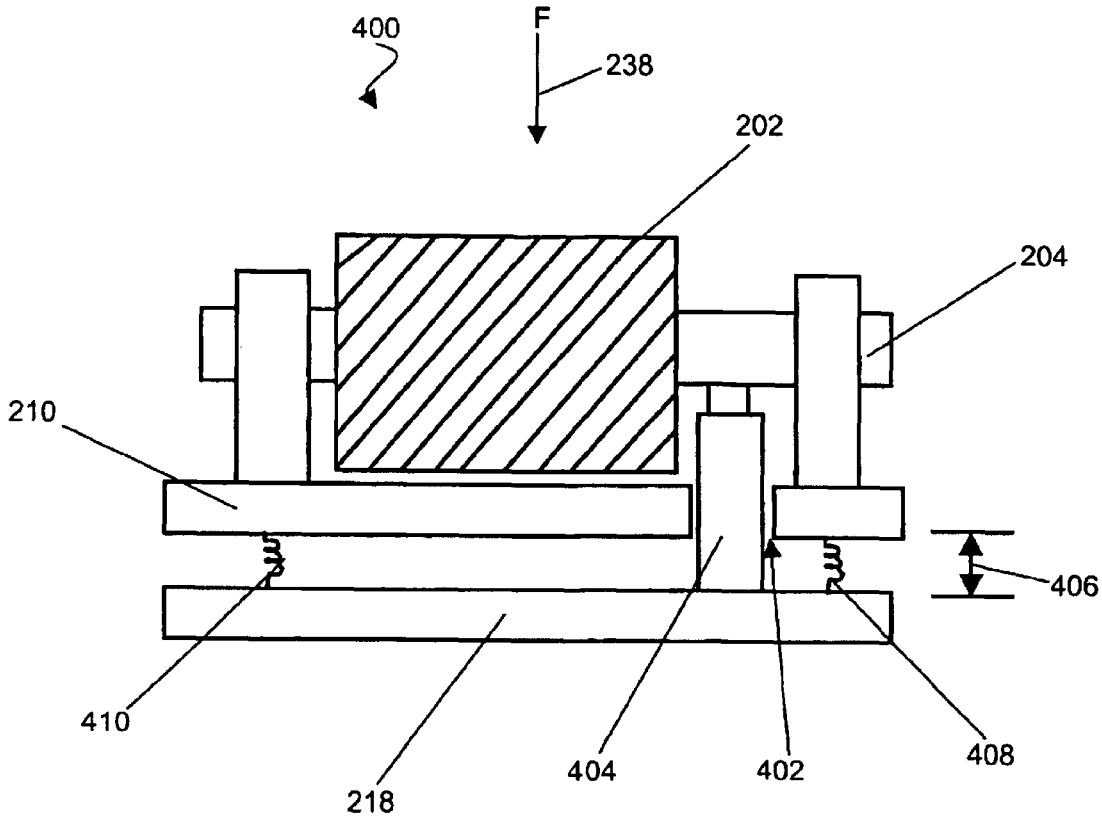
FIG. 13 is a cross-sectional view of a button-wheel embodiment in which the platform translates and the shaft physically contacts the switch to actuate the switch.

FIG. 13 is a cross-sectional view that depicts another embodiment of button-wheel 400 in which an aperture 402 in platform 210 enables a switch 404 to interact with shaft 204 instead of platform 210. In embodiments when switch 404 utilizes a technology that can provide spring-like response to push-type inputs applied by the user along the direction shown by direction arrow 238, then switch 404 may be a biasing member that interacts with shaft 204 that can be taken into account when selecting biasing members for button-wheel 400. The required height of the button-wheel 400 is reduced, since the dimension of gap 406 between the platform 210 and base 218 now has to accommodate only the maximally compressed biasing members 408 and 410, and not a maximally compressed switch 404. Since biasing members 408 and 410 do not require the electronics associated with switches and do not have to adopt the tubular compression/extension spring configuration as shown in FIG. 13, it is possible to include biasing members that occupy smaller dimensions than maximally compressed switches. Similar to the alternative biasing member and second sensor embodiments shown in FIGS. 8 to 13, although FIG. 13 shows one standard pushbutton switch 404 and the biasing members 408 and 410 as two standard extension/compression springs attached between platform 210 and base 218, alternative sensors and biasing member types and biasing member locations are possible.

The total possible translation in the direction shown by direction arrow 238 for wheel 202 as shown in the embodiments of FIGS. 5 through 13 can be defined by the maximum button depression of the associated switches and the maximum compression of the associated springs, or hard stops formed by other associated button-wheel features (such as blocking piece 328). It is also contemplated that additional features or components can be included to further define the maximum translation possible for wheel 202.

It is also within the scope of this preferred embodiment to utilize second sensors capable of indicating multiple levels (extent) of user push-type inputs. For example, the various pushbutton switches shown in FIGS. 5 through 9 can be pushbutton switches with at least two positions of switch actuation such that they can indicate at least three levels of compression, and thus at least three levels of translation of platform 210. The additional information relating to the level of translation of platform 210 may be useful in some input devices by enabling one level of translation and associated position of switch actuation to trigger one action while additional levels of translation and associated positions of switch actuation trigger alternative actions.

Multiple levels of translation can also be provided by many of the alternative technologies possible for the second sensor. For example, for the breakbeam sensor 322 shown in FIG. 10, blocking piece 328 can be designed such that a pattern of passages instead of a single passage is present in blocking piece 328 such that different levels of platform 210 translation results in different levels of light blockage from emitter 324 to detector 326. For the proximity sensor 336 shown in FIG. 11, standard proximity sensor technology, such as capacitive or hall effect sensors, produce an analog signal dependent on the separation between the first sensor member 338 and the second sensor member 340 and can sense a continuum of separation between the first sensor member 338 and the second sensor member 340. The strain gauges 342, 344, and 346 shown in FIG. 12 can also sense a continuum of deflection of the associated biasing members. These signals from the proximity sensor and the strain gauges can be used to estimate the displacement of platform 210 from some reference and the level of translation of platform 210; the resulting estimate of displacement or translation and can even be differentiated over time to estimate the velocity and acceleration of platform 210.

The configuration of second sensors and biasing members shown in FIGS. 7 through 13 are preferably designed to ensure substantial translation of platform 210 in response to user push-type force along the direction shown by direction arrow 238 on wheel 202 regardless of the exact location of user push inputs on wheel 202. In most cases of substantial translation, some limited tilting (deviation from the direction shown by direction arrow 238) of platform 210 may still occur even though translation is still the primary action associated with switch actuation. In the case that a set of second sensors is used, and the second sensors have very high sensitivity to the motion of platform 210, then this limited tilting may be utilized to provide greater user control of the host device through the button-wheel (200, 300, 400).

For example, for the embodiment shown in FIG. 12, if the strain gauges 342, 344 and 346 are well characterized and the spring constants of the biasing members 348, 350 and 352 are known, then the signals from the strain gauges can be used to calculate the reaction forces provided by the different biasing members. If it is possible to further assume that the user force along the direction shown by direction arrow 238 dominates, and if the biasing members containing second sensors define a complete statically determinant situation associated with platform 210, then force equilibrium considerations are sufficient for estimating the location of user force input and user force magnitude. Alternatively, if the biasing members containing second sensors define a complete statically indeterminate situation, then additional geometric and material considerations may be necessary to estimate the location of user force input and user force magnitude.

However, since this estimate of user force input location is more accurate when the biasing members deflect in different ways, when platform 210 tilts to some limited extent, and when platform 210 only applies forces that can be neglected in the above calculations on components of the button-wheel other than the biasing members that contain second sensors, careful selection and placement of button-wheel components is required to ensure substantial translation of platform 210 and wheel 202 in response to user push-type inputs on wheel 202 along the direction shown by direction arrow 238, and to ensure that the magnitude of tilting is acceptable. Button-wheels that can estimate the effective magnitude and application point of the user input force enable finer user control, and are useful in some applications. Example applications include, and are not limited to, menu selection, horizontal or vertical scrolling, and game control.

The approach used with the strain gauges to estimate user force location can also be used when other switching technologies that can sense a continuum of translation levels are used. For example, load cells are ready alternatives. However, some second sensor technologies are not sufficiently sensitive to the motion of platform 210 and may require tilting of platform 210 of such a magnitude that substantial translation of platform 210 no longer occurs during switch actuation. Significant tilting is undesirable, and the use of second sensor technologies that require significant tilting of wheel 202 and platform 210 in estimating user input force locations are preferably avoided. One method of overcoming this limitation is to utilize second sensors of different technologies in the same button-wheel device; a type of second sensor can be used to generate switch actuation signals (which may be involve multiple levels of translation and positions of switch actuation) while another type of second sensor can be used to calculate reaction forces and estimate the location of user push inputs on wheel 202.

Although FIGS. 5 and 6 depict button-wheel embodiments that use only one switch that combines a second sensor with a biasing member and FIGS. 7 through 13 depict embodiments that use a total of three components that function as biasing members and/or second sensors, many other alternative configurations with different numbers and arrangements of the second sensors and biasing members are viable in ensuring substantial translation of platform 210 in response to user push-type inputs on wheel 202 along the direction shown by direction arrow 238, and in promoting a uniform tactile and displacement response to said user inputs. The actual number and placement of the second sensors and biasing members depend on whether or not combination second sensors and biasing members are used, and the size, shape, and material of platform 210. For example, if the region of platform 210 that supports the button-wheel 200, 300, 400 has a relatively rectilinear shape, then a total of four biasing members placed near the corners of this region may be preferred; if none of the biasing members are part of a component that also functions as a second sensor, then some type of second sensor that produces reaction forces that are negligible when compared to the biasing members may be placed anywhere on platform 210 where it is possible to properly sense user push-type inputs. It is also possible to utilize greater numbers of biasing members to complement a rectilinear region of platform 210. For example, five biasing members can be distributed with one at the center of the rectilinear region and the other four at the corners.

Additional biasing members incur extra cost, and are useful only when the relatively square region is sufficiently large to require the extra support points to reduce undesirable tilting of the shaft and ensure substantial translation during switch actuation. In the case that the region of platform 210 that supports the button-wheel 200, 300, or 400 is elongated and is more oblong in shape, only a total of two biasing members may be necessary. For this more oblong shape, one biasing member can be located underneath the shaft on one side of the wheel while the other can be located underneath the shaft on the other side of the wheel. Similar to the rectilinear case described above, if none of the biasing members are part of components that also function as second sensors, then some type of second sensor that produces reaction forces that are negligible when compared to the biasing members may be placed anywhere on platform 210 where it is possible to properly sense user push-type inputs.

The button-wheel components can be located and oriented in alternative configurations to lower the cost and complexity of the final device. For example, if platform 210 is a circuit board with conductive traces to facilitate the acquisition and transmission of button-wheel signals, then the switch (or switches) of the button-wheel can be mounted on the side of platform 210 opposite from wheel 202 and placed in direct electrical communication with the circuit board traces (through standard surface mount technology, via technology, through-hole technology, or other means if necessary). With this configuration, when the user applies push-type force on wheel 202 along the direction shown by direction arrow 238, platform 210 substantially translates toward support frame 216 and depresses the button(s) of the switch(es) against the support frame 216 and switch actuation occurs. The resulting switch actuation will be almost identical from the user's perspective to the embodiment where the switch(es) is(are) mounted on support frame 216.

Additional variations of this embodiment are viable and still retain equivalence to the invention described within this document. Such variations include, but are not limited to, the following. The exact component technologies and types can change; for example, the wheel encoder can be optical or mechanical. The component sizes and shapes can also vary; for example, the wheel can be disc-like, cylindrical, spherical, have circular cross-section, have polygonal cross section, or have variable cross-sectional shape across the width of the wheel; or, the shaft may also vary in cross-section, and contain stepped or rounded features as necessary to achieve its functions and to simplify button-wheel construction.

Other button-wheel embodiment may also utilize components that perform the function of many parts of the button-wheel; examples of components that can easily combined into contiguous units include, but are not limited to: at least part of a first mount and at least part of a mount supporting wheel shaft 204, at least part of wheel 202 and at least part of any rotary tactile feedback mechanisms, and at least part of wheel 202 and at least part of wheel shaft 204. In fact, wheel 202 can be as simple as an elastomeric material covering directly molded onto wheel shaft 204, or a region of wheel shaft 204 can be denoted wheel 202 such that wheel 202 is integral to wheel shaft 204. The button-wheel may also utilize parts fashioned from many distinct components; for example, a first sensor can comprise of a breakbeam sensor formed from a photoemitter, an encoder disc that rotates in response to rotation of wheel 202, and a photodetector.

The embodiments can also utilize component mounting methods and mounting locations different from those described in FIGS. 5 through 13; for example, the biasing members and second sensors (translation sensors) can be mounted on platform 210 or support frame 216 and can be oriented in a variety of ways as long as they still ensure substantial translation of platform 210 along the direction shown by direction arrow 238, properly sense translation of platform 210 along the direction shown by direction arrow 238, and provide uniform tactile force and displacement feedback parallel to the direction shown by direction arrow 238 in response to push-type forces on wheel 202 along the direction shown by direction arrow 238.

Figure 14:
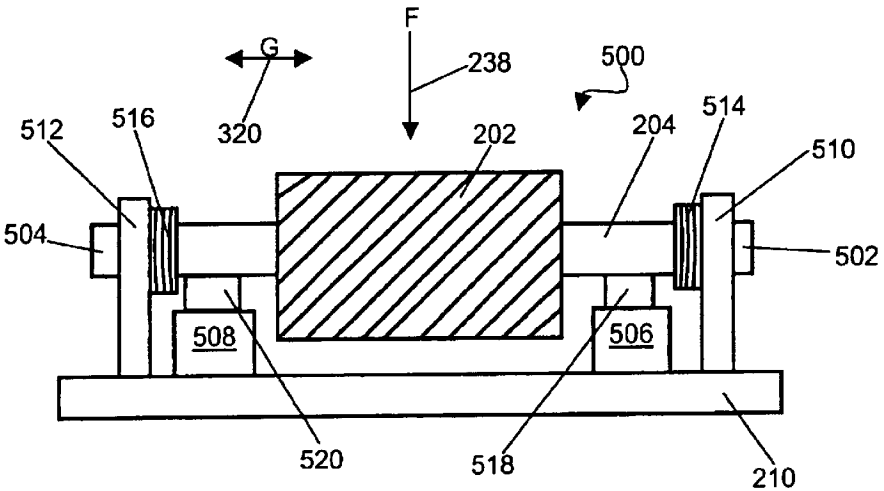
FIG. 14 is a cross-sectional view of a button-wheel embodiment in which the shaft translates independently from the platform to actuate the switch.

FIGS. 14 through 17 and 21 through 34 depict another embodiment in which members support the shaft, in preferred embodiments biasing members bias the wheel shaft (either by direct physical contact or through bearings and other components that support the wheel shaft) to ensure substantial translation of the wheel shaft and wheel and uniform tactile feedback along the width of the wheel in response-to push-type force on the wheel along the direction shown by direction arrow 238. In some embodiments, at least one mount that supports the shaft is composed of more than one distinct component or element, such as a slotted shape functioning in conjunction with a biasing member. As shown in FIG. 14 (an embodiment of button-wheel 500), the shaft 204 has a first end 502 that can translate independently from a second end 504 located opposite thereof. The first end 502 can move with a vector component along the direction shown by direction arrow 238 while second end 504 does not move or moves with a vector component opposite the direction shown by direction arrow 238. However, shaft 204 is carefully biased toward the user by biasing members such that ends 502 and 504 largely translate together along the direction shown by direction arrow 238. Thus, when the user applies push-type force on wheel 202, wheel shaft 204 substantially translates independently from platform 210 and actuates at least one second sensor. To ensure substantial translation of shaft 204 along the direction shown by direction arrow 238 and improve the uniformity of tactile force and displacement feedback in response to push-type inputs along the direction shown by direction arrow 238, additional features and components may be used to further guide and constrain shaft 204.

Figure 15:
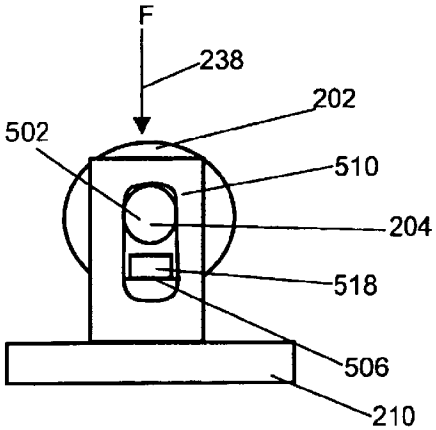
FIG. 15 is a side view that corresponds with FIG. 14.
Figure 17:
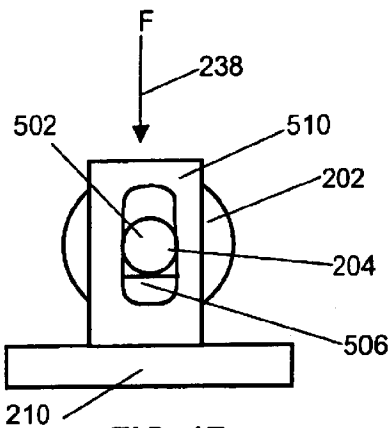
FIG. 17 is a side view that corresponds with FIG. 16.
Figure 16:
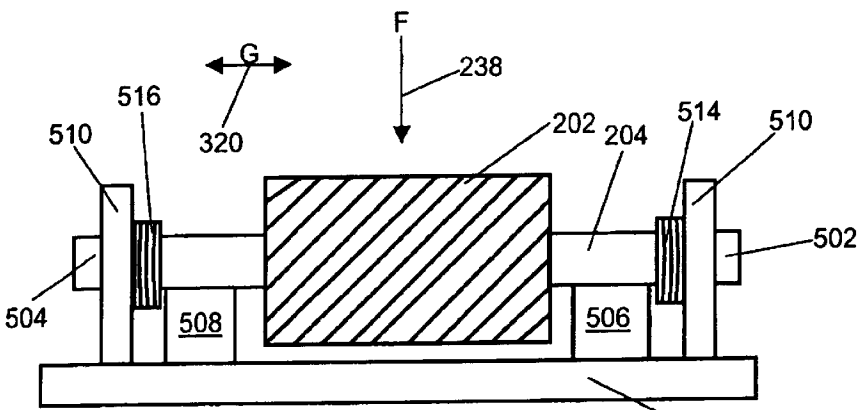
FIG. 16 is a cross-sectional view of the button-wheel embodiment shown in FIG. 14 in the configuration in which the switches are depressed.

FIGS. 14 through 17 illustrate embodiments in which shaft 204 is supported by two switches 506 and 508 that function as both biasing members and second sensors (translation sensors). Switches 506 and 508 are shown as pushbutton switches in FIGS. 14 through 17, but they can be of any type of translation sensor that can also provide spring-like reaction force in response to translation of shaft 204 along the direction shown by direction arrow 238. FIG. 14 is a cross-sectional view depicting the situation in which switches 506 and 508 are not actuated, and FIG. 15 is the corresponding side view. FIG. 16 is a cross-sectional view depicting the situation in which the switches 506 and 508 are actuated, and FIG. 17 is the corresponding side view. FIGS. 14 through 17 do not explicitly show the first sensor that senses rotation of wheel 202 or, if included, the tactile feedback mechanism that provides tactile feedback in response to rotation of wheel 202. Any first sensors or rotational tactile feedback mechanisms can be located anywhere within the button wheel 500 as long as they do not interfere with the rotation or substantial translation of the button wheel 500, and properly sense rotation or provide feedback. These parts of the button-wheel can also utilize any of the designs disclosed in commercially available devices.

The two switches 506 and 508 are selected and located to bias wheel shaft 204 such that substantial translation of wheel shaft 204 results in response to push-type force on wheel 202 along the direction shown by direction arrow 238. Two mounting members 510 and 512, which are components with slot cutouts and are mountable to platform 210, interact with and constrain shaft 204. Two shaft collars (translation limiters) 514 and 516 interact with mounting members 510 and 512 to limit the amount of movement of shaft 204 along the directions indicated by the bi-directional arrow G 320. In the embodiment shown in FIGS. 14 through 17, the mounting members 510 and 512, shaft collars 514 and 516, and switches 506 and 508 are preferably very similar in shape and spring response along the direction shown by direction arrow 238; by making the members of a component type similar to others within the component type means that a simple, symmetric distribution of these components about wheel 202 is a viable design for ensuring substantial translation and uniform tactile feedback along the direction shown by direction arrow 238. If necessary, shaft collars 514 and 516 can also be increased in diameter such that they also function as tilt-limiting features that help reduce shaft tilt and ensure substantial translation of shaft 204. Shaft collars 514 and 516 can be separate components attached to the shaft: shaft collars 514 and 516 can also be features manufactured onto the shaft, such as steps or grooves cut into the shaft of materials molded onto the shaft.

With the configuration shown in FIGS. 14 to 17, when the user applies push-type force on the wheel 202 along direction F238, this force is transmitted through to shaft 204 and the buttons 518 and 520 of switches 506 and 508. In response, shaft 204, being guided by the spring-like reaction force of buttons 518 and 520, mounting members 510 and 512, and shaft collars 514 and 516, substantially translates toward and depresses buttons 518 and 520 to actuate switches 506 and 508.

Figure 18:
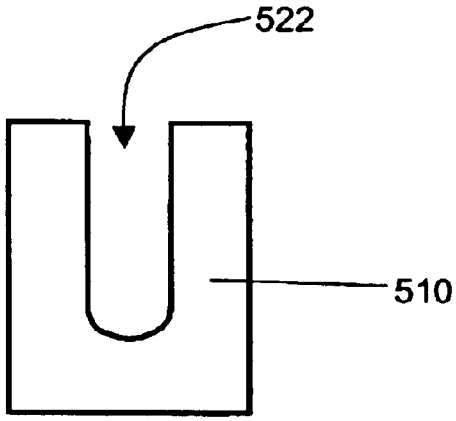
FIG. 18 depicts an alternate embodiment for the slotted shape that forms part of the mount that constrains the motion of the wheel shaft.
Figure 19:
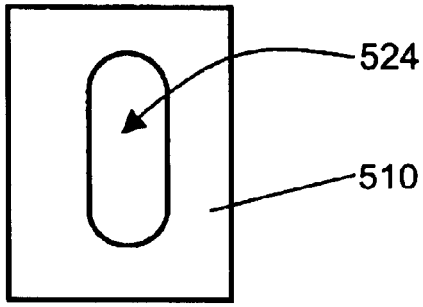
FIG. 19 depicts an alternate embodiment for the slotted shape that forms part of the mount that constrains the motion of the wheel shaft.
Figure 20:
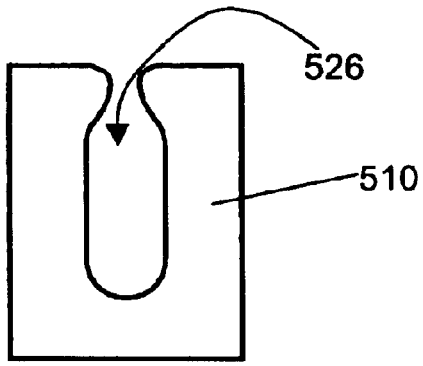
FIG. 20 depicts an alternate embodiment for the slotted shape that forms part of the mount that constrains the motion of the wheel shaft.

Platform 210 can be any relatively rigid part that properly supports the button-wheel components. However, if platform 210 is constructed as a circuit board with conductive traces, then the sensors of the button-wheel 500 can be directly powered and their signals routed by platform 210; this eliminates the need for additional routing components. Those skilled in the art will also note that different designs of the components shown in FIGS. 14 through 17 are also within the scope of this embodiment. For example, shaft 204 can contain additional features such as collars and extensions to facilitate switch actuation and to limit the travel of wheel 202 or shaft 204 along the direction shown by direction arrow G 320. The shaft can also replace shaft collars 514 and 516 with additional features such as grooves or steps to reduce cost or simplify manufacture. Alternate slot patterns in mounting members 510 and 512 are also possible, and some potential slot designs are shown in FIGS. 18 through 20; FIG. 18 shows an open, straight slot 522 that may facilitate assembly, FIG. 19 shows a closed slot that better retains shaft 204, and FIG. 20 shows a partially open, straight slot with small extensions near the opening to help retain shaft 204 (not shown).

Similar to other embodiments, this embodiment also only needs one second sensor (translation sensor) to be powered and connected to the button-wheel electronics for ON/OFF switch actuation. This means that either switch 506 or switch 508 can be replaced by a simple biasing member that provides the proper spring-type reaction force in response to user push-type input along the direction shown by direction arrow 238. For example, FIGS. 21 through 24 disclose embodiments of a button-wheel 700 that replaces switch 508 and mounting member 512 with a movable mount 702 mountable on a biasing member 704.

Figure 21:
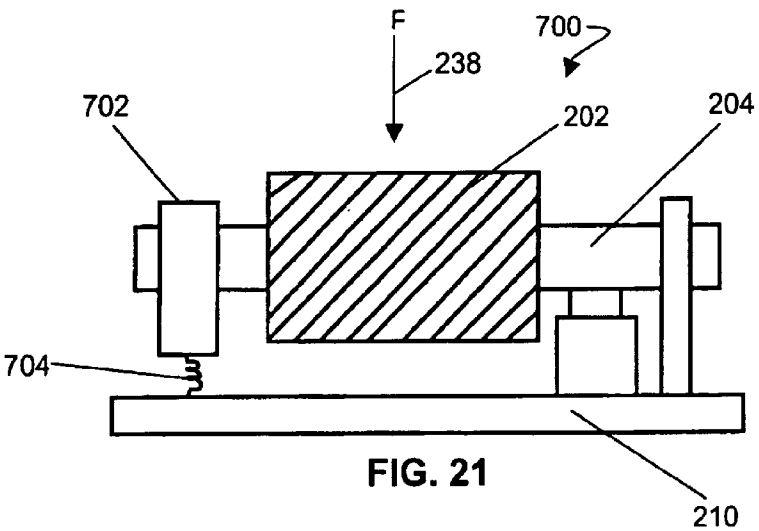
FIG. 21 is a cross-sectional view of a button-wheel embodiment in which a movable mount supported by a coiled spring enables one end of the wheel shaft to translate independently from the other end of the shaft.
Figure 22:
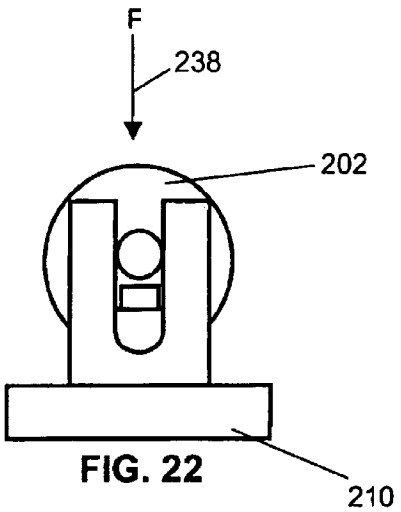
FIG. 22 is a side view that corresponds with FIG. 21.
Figure 23:
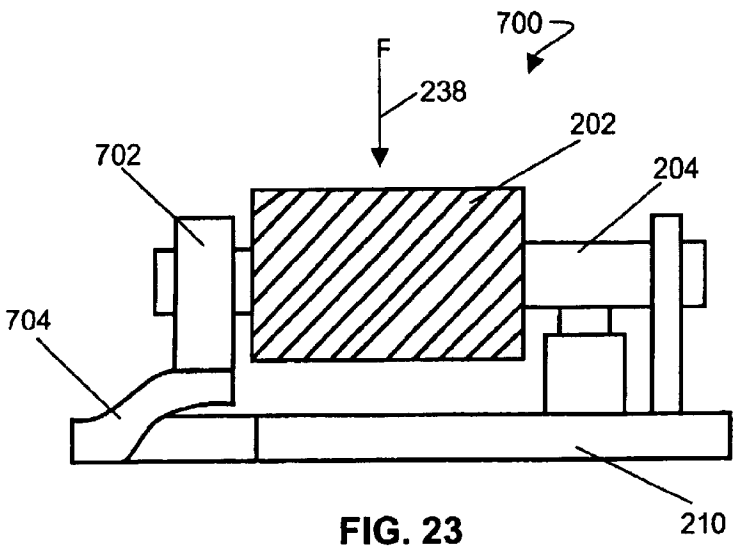
FIG. 23 is a cross-sectional view of a button-wheel embodiment in which a movable mount is supported by a flat spring.
Figure 24:
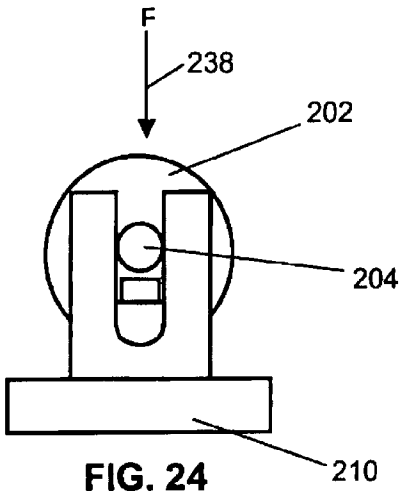
FIG. 24 is a side view that corresponds with FIG. 23.

FIG. 21 is a cross-sectional view of an embodiment that uses a standard extension/compression spring as a biasing member 704 mountable to the platform 210 to support movable mount 702, and FIG. 22 is the corresponding side view. The use of a standard extension/compression spring means that movable mount 702 also has limited mobility in directions that are not along the direction shown by direction arrow 238; this mobility in directions that are not along the direction shown by direction arrow 238 may lead to undesirable motions of shaft 204. However, proper design of biasing member 704 and other components that interact with shaft 204 can constrain this motion in directions that are not along the direction shown by direction arrow 238 to limit this motion to acceptable magnitudes and ensure substantial translation of shaft 204 along the direction shown by direction arrow 238 in response to push-type force on wheel 202 along the direction shown by direction arrow 238. If necessary, additional features (not shown) and components such as linear guides for the shaft 204 or tilt-minimizing features as discussed later within this document, can also be incorporated into the button-wheel 700 to guide the translation of shaft 204 along the direction shown by direction arrow 238. FIG. 23 is a cross-sectional view of another embodiment that uses a flat spring for the biasing member 704 mountable to the platform 210 to support movable mount 702, and FIG. 24 is the corresponding side view. Depending on the construction of the button-wheel 700, it may be easier and less costly to use flat springs instead of standard extension/compression springs; in addition, flat springs are usually more easily designed to reduce motion of shaft 204 in directions that are not along the direction shown by direction arrow 238.

Movable mount 702 can be a component that functions as a bearing, a first sensor, and a rotary tactile feedback mechanism. However, movable mount 702 would preferably be designed to not allow shaft 204 to tilt to help ensure substantial translation of shaft 204.

Figure 25:
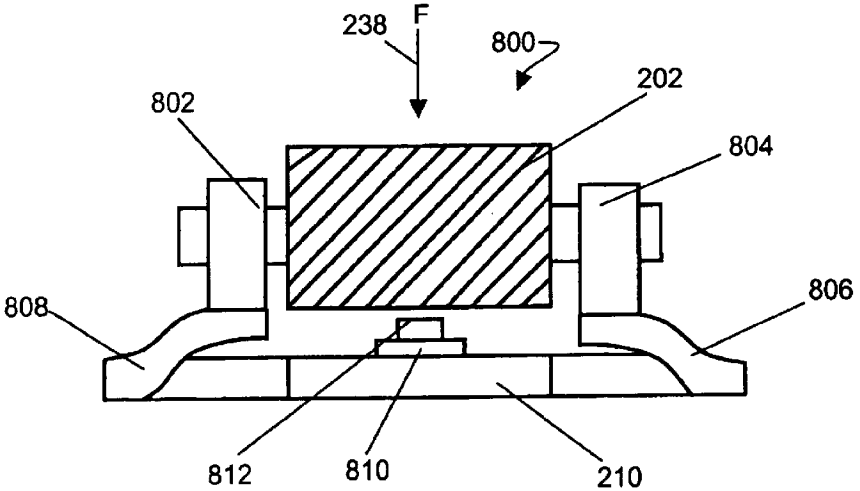
FIG. 25 is a cross-sectional view of a button-wheel embodiment in which two movable mounts are supported by flat springs.

FIG. 25 depicts a variation of another embodiment of button-wheel 800 in which both ends of shaft 204 are supported by movable mounts 802 and 804 mountable on biasing member 806 and 808 and a switch 810. The biasing members 806 and 808 and switch 810 are mountable to platform 210. The switch 810 in the embodiment shown in FIG. 25 combines the function of a second sensor and a biasing member placed under wheel 202. The biasing members 806 and 808 can be flat springs designed to bias and constrain shaft 204 to substantially translate along the direction shown by direction arrow 238 in response to push-type force on wheel 202 along the direction shown by direction arrow 238. When the user applies push-type force on wheel 202 along the direction shown by direction arrow 238, shaft 204 substantially translates along the direction shown by direction arrow 238 and movable mounts 802 and 804 compresses biasing members 806 and 808. With sufficient translation of shaft 204, wheel 202 contacts and depresses button 812 of switch 810 and actuates switch 810. Although FIG. 25 discloses a standard pushbutton switch as a second sensor (translation sensor), alternative second sensor technologies are also viable and are within the scope of this invention.

Figure 26:
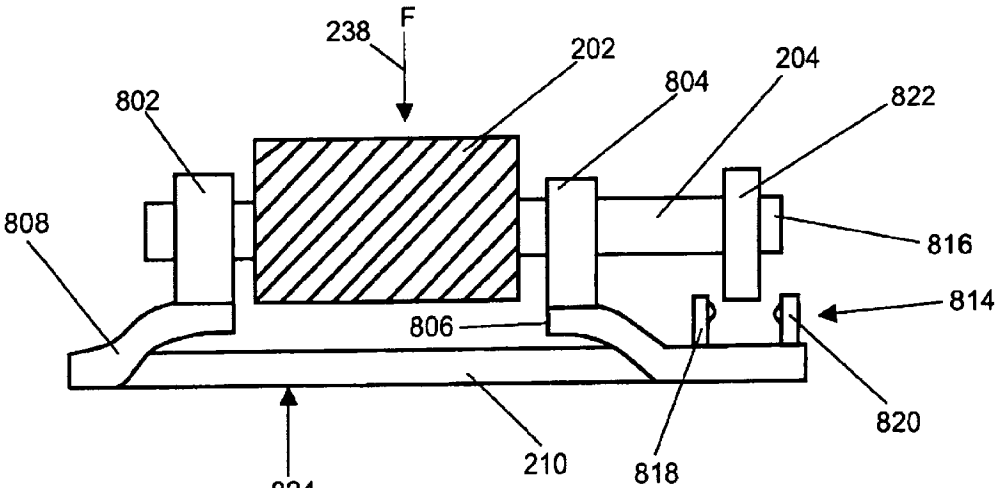
FIG. 26 is a cross-sectional view of a button-wheel embodiment utilizing a non-contact switch in which two movable mounts are supported by flat springs.

FIG. 26 shows a variation of the embodiment depicted in FIG. 25 in which shaft 204 has been elongated and the translation sensor or simply sensor 814 has been moved away from under wheel 202 to the side of mount 804 distal from wheel 202 and proximate to an end 816 of shaft 204. In addition, the sensor 814 can be a non-contact breakbeam-type sensor formed from photoemitter 818, photodetector 820 mountable to platform 210, and an extension 822 of shaft 204 proximate to end 816. This variation shown in FIG. 26 can accommodate a larger wheel 202 or a lower overall button-wheel height by enabling the designer to include a gap 824 under wheel 202 (neither a larger wheel nor a shorter button-wheel height is shown in FIG. 26). Since the sensor 814 does not apply forces on shaft 204 in response to push-type force on wheel 202 along the direction shown by direction arrow 238, biasing members 806 and 808 are designed to have similar spring response along the direction shown by direction arrow 238 and are arranged symmetrically about wheel 202 to help ensure substantial translation and uniform tactile feedback in response to push-type force along the direction shown by direction arrow 238. However, those skilled in the art will recognize that a switch with spring-like response can also be used and can interact with shaft 204 if its spring reaction forces are negligible compared to that of biasing members 806 and 808, or if its forces are taken into account while designing and locating biasing members 806 and 808. Alternative translation sensor technologies besides the breakbeam-type sensor can also be used and are within the scope of this invention. Some example second sensor technologies are described earlier for other embodiments.

The use of biasing members 806 and 808 in the embodiment shown in FIGS. 25 and 26 means that movable mounts 802 and 804 have some limited mobility in the non-F directions. However, proper design of the biasing members 806 and 808 while keeping in mind functional characteristics such as size and spring constant, can limit this non-F motion to acceptable magnitudes. The interaction of shaft 204 with movable mounts 802 and 804 will also limit non-F motion. Additional features and components (not shown) such as linear guides for the shaft or tilt-minimizing features as discussed later within this document, can be incorporated into the button-wheel 800 to guide the translation of shaft 204 along the direction shown by direction arrow 238.

Figure 27:
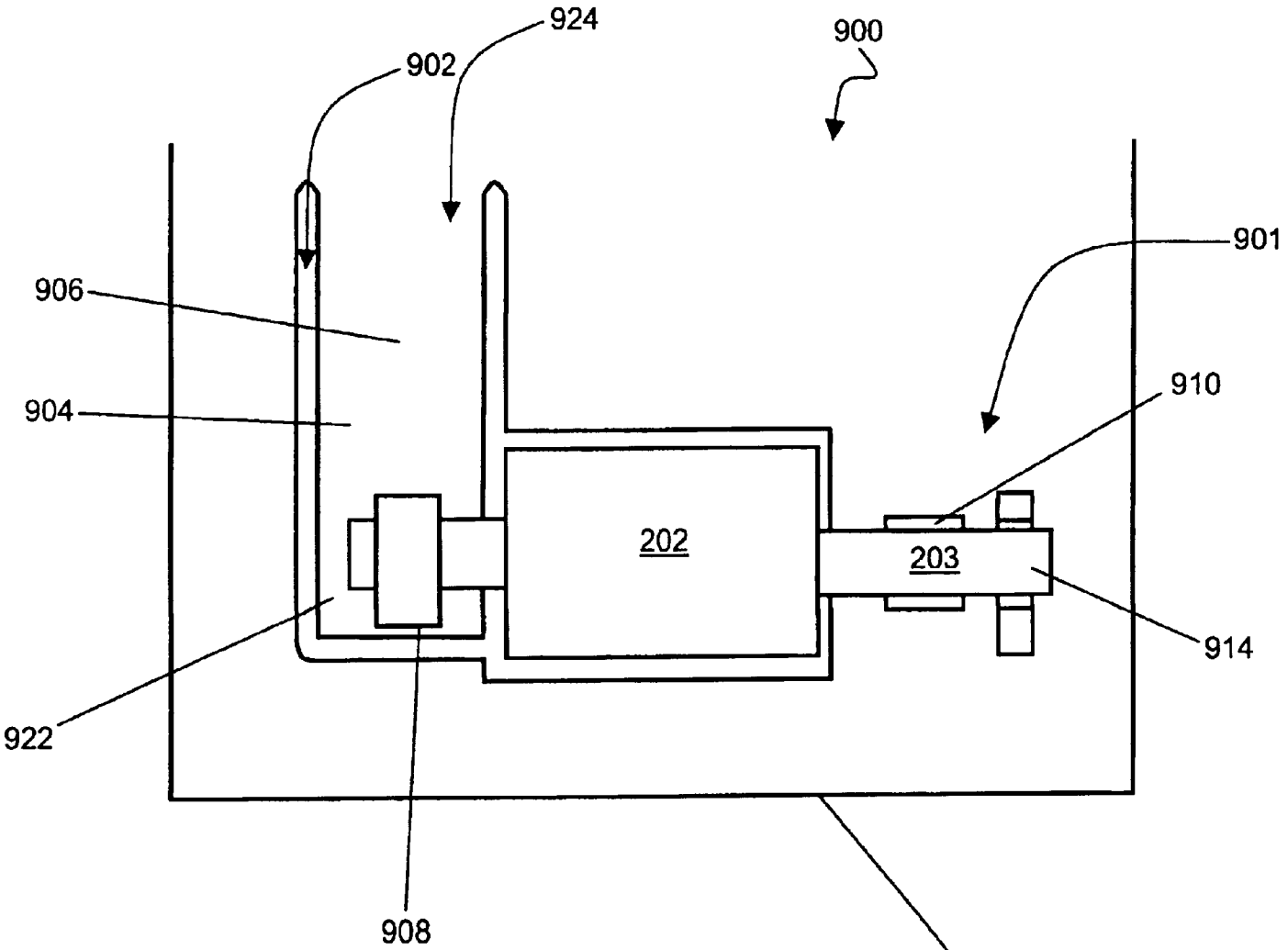
FIG. 27 is a top view of a button-wheel design in which a movable mount is supported by a cutout of the platform 3.
Figure 29:
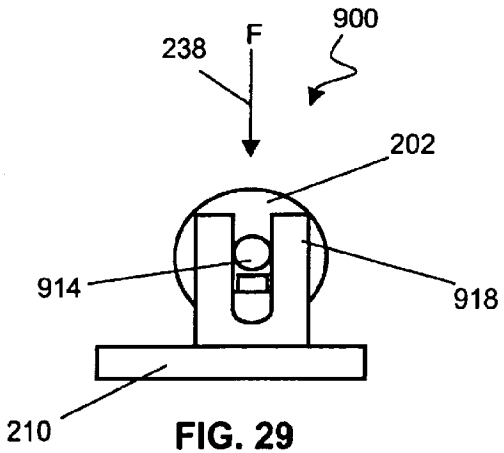
FIG. 29 is a side view that corresponds with FIG. 28.
Figure 28:
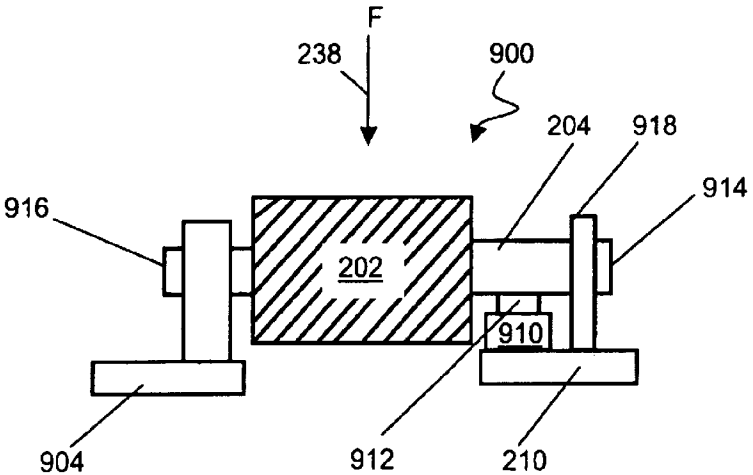
FIG. 28 is a cross-sectional view of the button-wheel embodiment depicted in FIG. 27.
Figure 31:
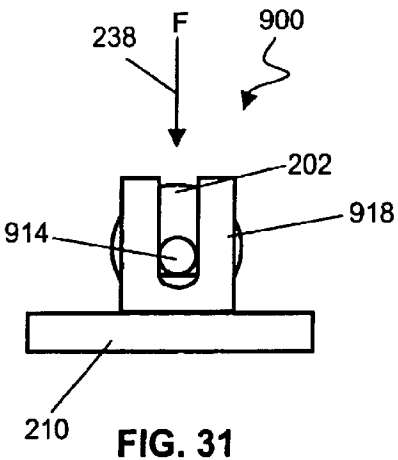
FIG. 31 is a side view that corresponds with FIG. 30.
Figure 30:
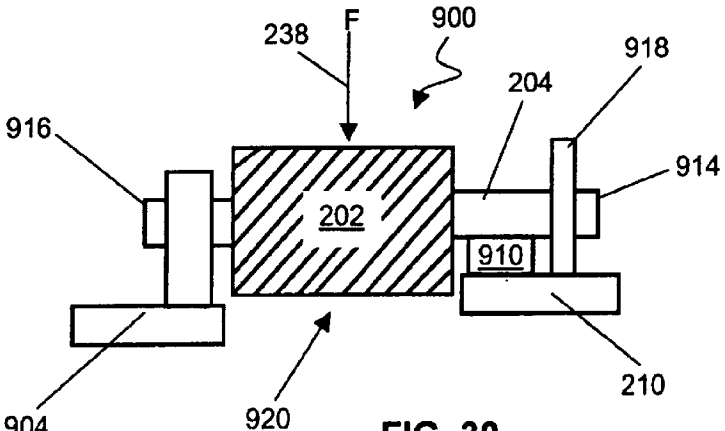
FIG. 30 is a cross-sectional view of the button-wheel design depicted in FIG. 27 in which the switch is depressed.
Figure 34:
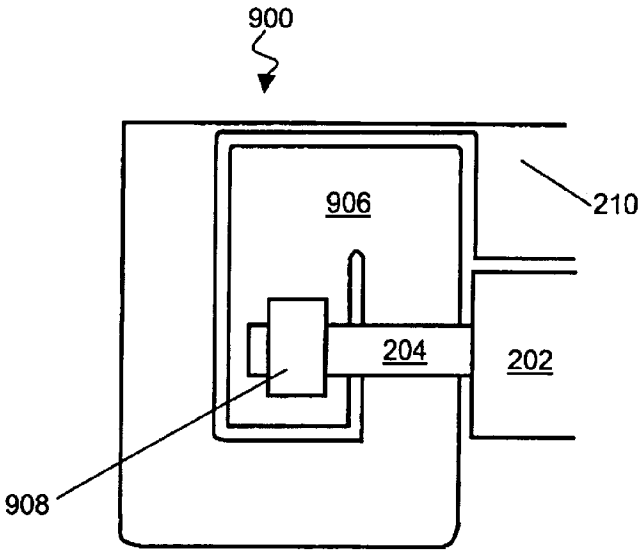
FIG. 34 is a partial top-view of an alternative cutout for the flexible, biasing member supporting the movable mount shown in FIGS. 27 through 33.
Figure 32:
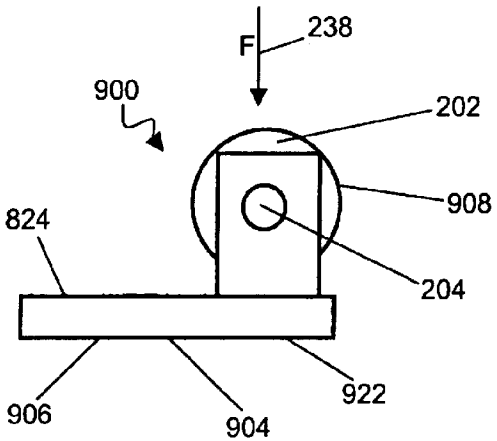
FIG. 32 is another side view that corresponds with FIG. 28.
Figure 33:
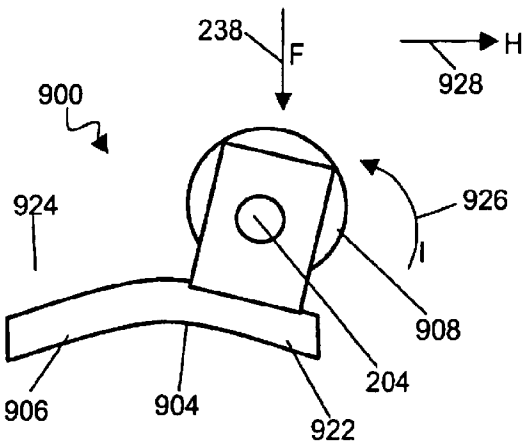
FIG. 33 is another side view that corresponds with FIG. 31.

FIGS. 27 through 34 depict another embodiment of button-wheel 900 in which platform 210 is a relatively rigid circuit board with a fixed region 901. The circuit board includes a cutout 902 that creates a biasing member 904 formed by a flexible region (flat-spring region) 906 rimmed by the cutout 902. Movable mount 908 is supportable by flexible region 906. FIG. 27 is a top view of this embodiment. FIG. 28 is a cross sectional view of the embodiment in a state in which switch 910 is not actuated and FIGS. 29 and 32 are corresponding side views. FIG. 30 is a cross sectional view of the embodiment in a state in which switch 910 is actuated and FIGS. 31 and 33 are corresponding side views. The embodiment disclosed in FIGS. 27 through 34 has the advantage of utilizing platform 210 for multiple functions—platform 210 provides mechanical support to the button-wheel components, electrical support to the button-wheel components, and a spring bias to movable mount 908.

When the user applies push-type force on wheel 202 along the direction shown by direction arrow 238, shaft 204 substantially translates along the direction shown by direction arrow 238 as biasing member 904 deflects and shaft 204 depresses button 912 of switch 910 and actuates switch 910. Shaft 204 has a first end 914 which can actually translate in a direction parallel to the direction shown by direction arrow 238 independently from a second end 916 wherein the second end 916 is located opposite the first end 914 of the shaft 204. A mounting member 918, switch 910, and biasing member 904 can be configured to ensure that shaft 204 substantially translates along the direction shown by direction arrow 238 and provides uniform tactile feedback parallel to the direction shown by direction arrow 238 in response to push-type force on wheel 202 along the direction shown by direction arrow 238. Cutout 902 also includes a void 920 formed in platform 210, through which wheel 202 can move unabated; this allows the designer to include a larger wheel 202 or reduce the total height of the button-wheel 900.

The embodiment depicted in FIGS. 27 through 34 requires careful biasing of biasing member 904; in addition, the embodiment uses biasing member 904 to facilitate the translation of movable mount 908 and switch 910 actuates through physical contact of button 912 with shaft 204, not biasing member 904.

Specific selection of the geometry of biasing member 904 and the material of platform 210 is necessary to achieve proper biasing and substantial translation of shaft 204 along the direction shown by direction arrow 238 in response to push-type force on wheel 202 along the direction shown by direction arrow 238. The substantially planar and rectilinear shape of biasing member 904 shown in FIGS. 27 through 33 is chosen to minimize manufacturing costs and the amount of tilt and motion in directions that are not along the direction shown by direction arrow 238 in shaft 204 in response to push-type force along the direction shown by direction arrow 238. Flexible region 906 includes a mount support region located proximate to the movable mount 908 and a cantilever base region 924 located distal from the movable mount 908 (See FIGS. 27 and 33). The cantilever base region 924 of flexible region 906 undergoes the greatest deformation while the mount support region 922 of flexible region 906 undergoes the greatest motion relative to the platform 210. As shown in FIG. 33, the deflection of the biasing member 904 causes movable mount 908 to reorient in a manner that matches the rotational freedom of shaft 204; thus, shaft 204 can accommodate this change in orientation while experiencing negligible torsion simply by rotation in the direction indicated by direction arrow 1 926. Some translation of shaft 204 in the direction indicated by direction arrow H 928 will also occur. However, translation along direction H 928 is the least negative of the three translational directions in 3D space on ensuring substantial translation of shaft 204, and, with the small distance typically traveled by shaft 204, this translation along direction H 928 is negligible.

Those skilled in the art will recognize that alternate geometries for biasing member 904 may be preferable to accommodate different space constraints, to accommodate manufacturing concerns, or to produce even purer translation of shaft 204 along the direction shown by direction arrow 238. For example, elongating biasing member 904 enables movable mount 908 to approach a pure translational motion along the direction shown by direction arrow 238. Alternatively, a biasing member 904 formed from the flexible region 906 having geometry such the spiral pattern shown in FIG. 34 enables movable mount 908 to approach a pure translation along the direction shown by direction arrow 238. However, these alternatives usually require more space than the pattern shown in FIG. 27, and might not offer noticeable improvement in button-wheel performance above what is already achieved with the biasing member 904 shown in FIGS. 27 through 33.

Those skilled in the art will also note that biasing member 904 is not limited in material or in manufacture as a part of platform 210. Biasing member 904 can be formed from other parts of the button-wheel 900 and the button-wheel host input device (not shown) as long as the biasing member 904 provides the necessary spring-like response to push-type force on wheel 202 along the direction shown by direction arrow 238. For example, biasing member 904 can be formed as a separate component from standard spring metals such as steel or copper and incorporated into the button-wheel 900. Biasing member 904 can also be an extension or cutout of platform 210, an extension or cutout of a mounting bracket (not shown) for the button-wheel, or an extension or cutout of the support frame 216 manufactured from plastic, metal, composite, or other material capable of providing spring-like response. It is also contemplated that biasing member 904 can comprise of additional stiffening features or components that stiffen a highly flexible component or highly flexible region of a component that is too flexible to provide the necessary biasing force. The highly flexible component or region of a component can comprise of a flexible printed circuit or a flexible membrane with conductive traces on its surface. The additional stiffening features and additional members can comprise of extensions from a mounting bracket, extensions from the support frame 216, or separate stiffeners that have been attached to the button-wheel specifically to stiffen the highly flexible component or highly flexible region of a component.

Although FIGS. 14 through 17 depict only two pushbuttons as second sensors and FIGS. 21 through 34 depict only one pushbutton as a second sensor, other numbers, types, and configurations of second sensors can also be used. These alternatives can act as backup sensors, help ensure substantial translation of shaft 204, produce more uniform tactile feedback, or provide additional information on the translation of shaft 204. For the embodiments shown in FIGS. 25 through 34, a simple way to add second sensors to the button wheel 800, 900 is to include strain gauges that produce signals in response to the deformation of biasing members 806, 808, or 904. Additional examples of alternative second sensor technologies are also disclosed in the above descriptions of embodiments.

Similar to the earlier discussed embodiments, this embodiment can also utilize second sensors and methods that enable the button-wheel to sense multiple levels of translation (extent of translation) and estimate the magnitude and location of the push-type force on wheel 202 along the direction shown by direction arrow 238. In addition, the components of the earlier embodiments can also be mounted in different locations, on alternate surfaces, and in different orientations to accommodate different design constraints; the designer must only ensure these changes do not alter the functionality of the button-wheel 800, 900. Different designs of shaft 204 are also viable, and shaft 204 can contain additional features such as collars and extensions to facilitate switch actuation and to limit the travel of shaft 204 along the direction shown by the direction arrow G 320. Alternate mounting member designs are also viable, and FIGS. 18 through 20 depict some alternatives.

Figure 35:
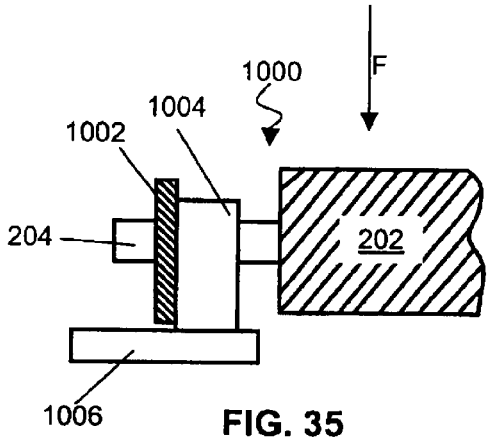
FIG. 35 is a partial cross-sectional view that depicts a feature that can be added to the wheel shaft to reduce undesirable tilting of the shaft during switch actuation.

In this embodiment, shaft 204 will usually tilt to some extent; however, in most applications, a moderate amount of tilt is acceptable since the resulting motion is still substantially translational. FIGS. 35 through 41 disclose some methods to produce a smoother and more uniform translational motion for shaft 204 by reducing the undesirable tilt of shaft 204. FIG. 35 shows a partial cross-section of an embodiment of button-wheel 1000 having a tilt reducer mechanism composed of a stop member 1002 with a cylindrical shape mountable on shaft 204. Stop 1002 interacts with movable mount 1004. Rotational motion of wheel 202 about its axis is impeded minimally by the interaction between stop member 1002 and movable mount 1004. However, forces and moments which may lead to shaft 204 tilt causes stop member 1002 to contact movable mount 1004; these tilting forces are then absorbed by movable mount 1004 and transmitted to a base 1006 (which may be platform 210 or flexible region 906 in other embodiments) on which movable mount 1004 is mountable. Shaft 204 tilts only as much as allowed by stop member 1002, movable mount 1004, and base 1006. Stop member 1002 can also be made at least a part of a rotational feedback detent mechanism or a first sensor encoder mechanism to simplify assembly, reduce costs, or reduce component count.

Figure 36:
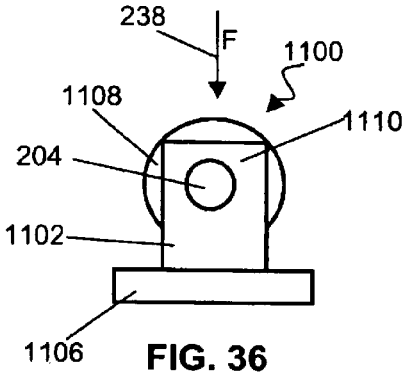
FIG. 36 is a side view that depicts an additional shaft mount that reduces undesirable tilting of the shaft during switch actuation.
Figure 37:
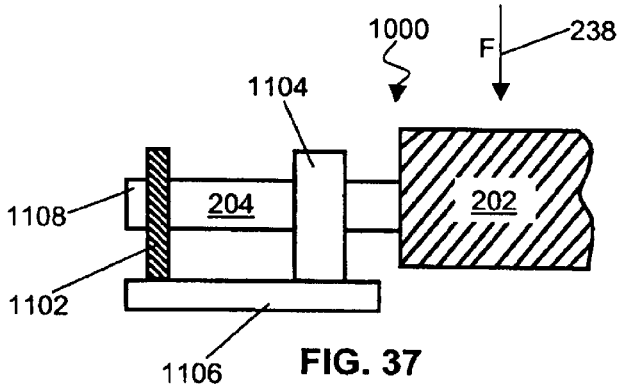
FIG. 37 is a partial cross-sectional view that corresponds with FIG. 36.
Figure 38:
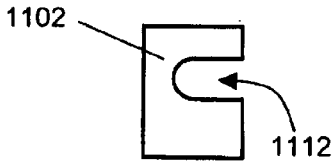
FIG. 38 depicts an alternate embodiment for the additional mount depicted in FIGS. 36 and 37.
Figure 39:
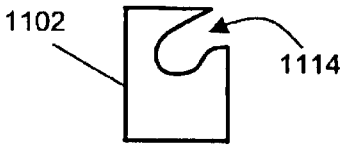
FIG. 39 depicts an alternate embodiment for the additional mount depicted in FIGS. 36 and 37.
Figure 40:
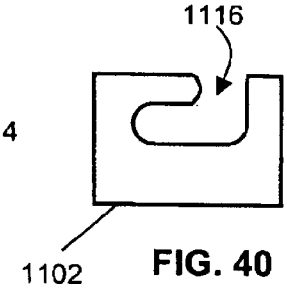
FIG. 40 depicts an alternate embodiment for the additional mount depicted in FIGS. 36 and 37.

FIGS. 36 and 37 show an embodiment of a button-wheel 1100 in which a tilt reducer mechanism comprises of an additional mount 1102 working in conjunction with movable mount 1104 to reduce the undesirable tilting of shaft 204 during switch actuation. Additional mount 1102 is mountable to base 1106. Additional mount 1102 limits the travel of second end 1108 of shaft 204 relative to movable mount 1104, parallel to the direction shown by direction arrow 238, and helps keep shaft 204 in line with cutout 1110 formed in additional mount 1102 and movable mount 1104. Additional mount 1102 can contain any cutout shape that limits the travel of shaft 204 relative to movable mount 1104 parallel to the direction shown by direction arrow 238. Some examples in addition to the circular cutout shown in FIGS. 36 and 37 are depicted in FIGS. 38 to 40. FIG. 38 shows a horizontal cutout 1112 formed in additional mount 1102, FIG. 39 shows a slanted cutout 1114 formed in additional mount 1102, and FIG. 40 shows an L-shape cutout 1116 formed in additional mount 1102. These alternatives may make button-wheel assembly easier than a pure circular cutout. The actual cutout shape will be determined by the geometry of the button-wheel.

Figure 41:
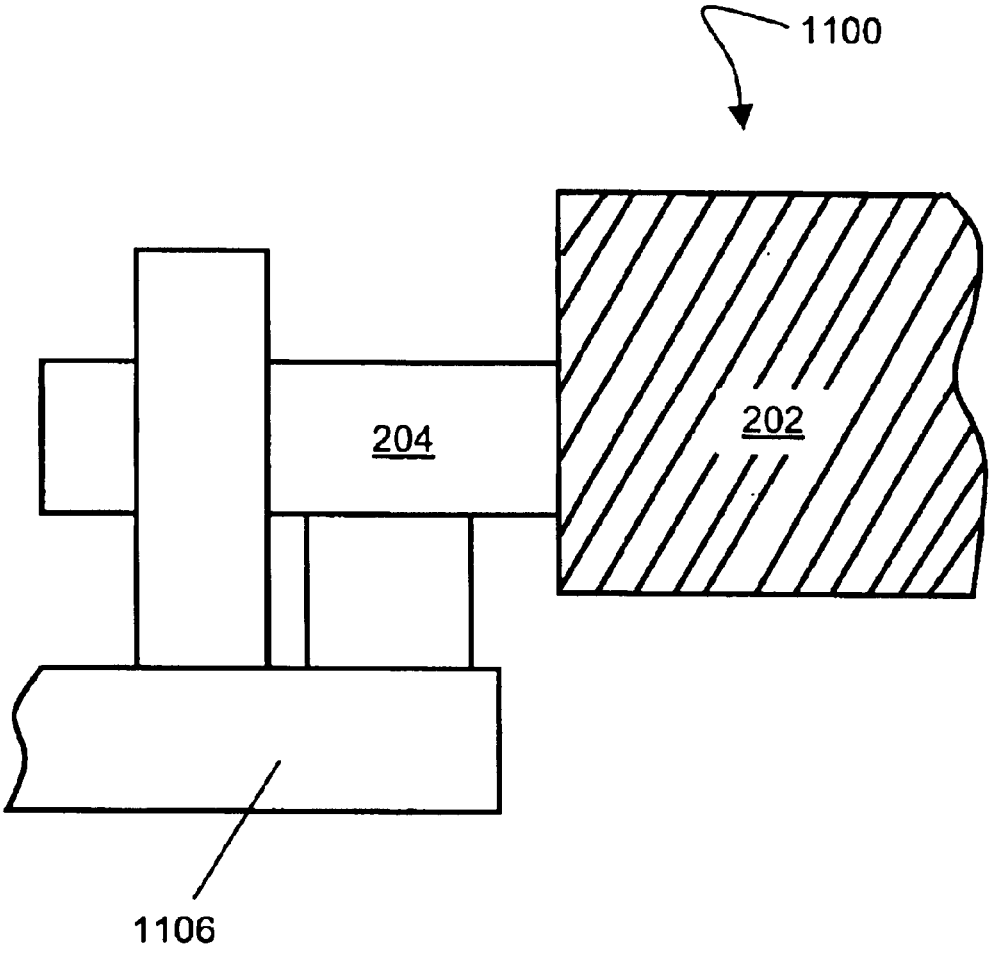
FIG. 41 is a partial cross-sectional view of an additional support that reduces undesirable tilting of the shaft during switch actuation.

FIG. 41 is a partial cross-sectional view of an embodiment having a tilt reducer mechanism comprising a hard stop 1118 (hard stop 1118 is not labeled in FIG. 41) mountable to the base 1106 under shaft 204. The hard stop 1118 can be used in conjunction with movable mount 1104 to minimize the undesirable tilting of shaft 204 during switch actuation. Rotational motion of wheel 202 about its axis is impeded minimally by the interaction between shaft 204 and hard stop 1118. However, forces and moments which may lead to shaft 204 tilt causes shaft 204 to impact hard stop 1118 and transmit these forces and moments into base 1106. This limits the motion of shaft 204 relative to movable mount 1104 and thus the tilting of shaft 204.

The additional features and components disclosed in FIGS. 35 through 41 can also be made at least a part of a rotational feedback detent mechanism or a first sensor encoder mechanism to simplify assembly, reduce costs, or reduce component count.

Those skilled in the art will note that even if the button-wheel design of the embodiments disclosed utilizes no tilt-limiting techniques, the substantially translational action is still a significant improvement on the substantially tilting action of prior art button-wheel devices.

For both the embodiments disclosed, those skilled in the art will note that many additional variations on these two preferred button-wheel embodiments are viable and still retain equivalence. Such variations include, but are not limited to, the following. The exact component technologies and types can change; for example, the wheel encoder can be optical or mechanical. The component sizes and shapes can also vary. For example, the wheel can be disc-like, cylindrical, spherical, have circular cross-section, have polygonal cross section, or have variable cross-sectional shape across the width of the wheel; the shaft may also vary in cross-section, and contain any stepped or rounded features as necessary to achieve its functions or to simplify button-wheel manufacture. The component mounting methods and mounting locations can differ. For example, the mounting member can be mountable on the bottom, top, or sides of the support frame, on ribs or extensions of the support frame, or on the circuit board supporting the button, encoder, and other electronics. The button-wheel may also utilize combination parts that perform the function of many components. For example, the mount and encoder can be combined into one part, the detent mechanism and the wheel can be combined into one part, or the wheel can be molded onto the shaft or a region of the shaft can function as the wheel. The button-wheel may also utilize components fashioned from many sub-parts. For example, the encoder can consist of a photoemitter, an encoder disc, and a photodetector and utilize breakbeam-type technology.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A button wheel comprising:

a support frame including a first region and a second region, said first region being a spring region;

a first mount disposed on said first region of said support frame;

a second mount spaced apart from said first mount and disposed on said support frame at said second region;

a translation sensor mounted at a fixed position with respect to said support frame;

a shaft disposed along an axis and including a wheel mounted thereon, said shaft including a first end rotatably engaged in said first mount and a second end rotatably and translatably engaged in said second mount so as to allow said shaft to translate with respect to said support frame in a direction substantially perpendicular to said axis to actuate said translation sensor upon the application of mechanical force to said wheel having a component substantially along said direction; and a rotation sensor in operative communication with said wheel.

2. The button wheel of claim 1 wherein said translation sensor is selected from the group consisting of a pushbutton switch, a snap dome switch, a breakbeam sensor, a strain gauge and a proximity sensor.

3. The button wheel of claim 1 wherein said first region of said support frame is configured with a spiral pattern geometry.

4. The button wheel of claim 1 wherein said first region of said support frame is formed as an L shaped region.

5. The button wheel of claim 1 wherein said first region of said support frame is formed as a straight region.

6. The button wheel of claim 1 wherein said support frame includes an aperture formed thereon and wherein said wheel is at least partially disposed in said aperture when said wheel is translated.

7. The button wheel of claim 1 wherein said support frame includes an aperture formed thereon and wherein said wheel is at least partially disposed in said aperture when said wheel is at rest.

8. The button wheel of claim 1 wherein said first region is a flat-spring region.

9. The button wheel of claim 1 further comprising at least one biasing member coupled to said support frame.

10. The button wheel of claim 1 wherein said translation sensor includes a biasing member.

11. The button wheel of claim 1 further comprising at least one additional translation sensor.

12. The button wheel of claim 1 wherein said translation sensor includes a button mounted proximate to said support frame.

13. The button wheel of claim 1 wherein said translation sensor is comprises at least one strain gauge integral with said support fame.

14. The button wheel of claim 1 wherein said translation sensor is configured to provide a signal that varies as a function of the extent of translation from a rest position in said direction.

15. The button wheel of claim 1 wherein said second region is a fixed region.

16. The button wheel of claim 1 further comprising:

a first translation limiter disposed on said shaft proximate said first end and adjacent to said first mount to limit the translation of said shaft along said axis;

a second translation limiter disposed on said shaft proximate said second end and adjacent to said second mount to limit the translation of said shaft along said axis.

17. The button wheel of claim 1 wherein said translation sensor senses extent of translation.

18. The button wheel of claim 1 wherein said translation sensor is configured to estimate position of an input force.

19. The button wheel of claim 1 wherein said shaft includes a distal extension on one of said first end and said second end, and said translation sensor is disposed in operative communication with said shaft at a location proximate to said distal extension.

20. The button wheel of claim 1 wherein said translation sensor is configured to sense at least three discrete translation positions of said wheel.

21. A button-wheel comprising:

a base;

a shaft rotatably coupled to said base about an axis of rotation and translatable in a direction substantially perpendicular to said axis of rotation;

a wheel fixedly mounted on said shaft;

a translation sensor in operative communication with said wheel and configured to sense at least three discrete translation positions of said wheel in said direction substantially perpendicular to said axis of rotation.

* * * * *